US010864573B2

(12) United States Patent
Kohno

(10) Patent No.: US 10,864,573 B2
(45) Date of Patent: Dec. 15, 2020

(54) HYDRAULIC KNOCKOUT DEVICE

(71) Applicant: AIDA ENGINEERING, LTD., Kanagawa (JP)

(72) Inventor: Yasuyuki Kohno, Kanagawa (JP)

(73) Assignee: AIDA ENGINEERING, LTD., Kanagawa (JP)

( * ) Notice: Subject to any disclaimer, the term of this patent is extended or adjusted under 35 U.S.C. 154(b) by 319 days.

(21) Appl. No.: 15/877,813

(22) Filed: Jan. 23, 2018

(65) Prior Publication Data

US 2018/0214932 A1 Aug. 2, 2018

(30) Foreign Application Priority Data

Jan. 27, 2017 (JP) ..... 2017-013253

(51) Int. Cl.
*B21J 13/14* (2006.01)
*B30B 15/16* (2006.01)
(Continued)

(52) U.S. Cl.
CPC ..... *B21J 13/14* (2013.01); *B21J 9/12* (2013.01); *B30B 15/163* (2013.01); *F15B 1/02* (2013.01);
(Continued)

(58) Field of Classification Search
CPC ..... B21J 13/14; B21J 9/12; B30B 15/163; B30B 15/32; F15B 21/042; F15B 1/02;
(Continued)

(56) References Cited

U.S. PATENT DOCUMENTS 3,135,140 A * 6/1964 Ottestad ..... B21J 7/34 100/269.14
3,222,914 A * 12/1965 Monahan ..... B21J 7/34 72/453.1
(Continued)

FOREIGN PATENT DOCUMENTS

EP 0 947 259 A2 10/1999
EP 2 158 982 A1 3/2010
(Continued)

OTHER PUBLICATIONS

Extended Search Report issued in corresponding European Patent Application No. 18151802.8-1019, dated Aug. 2, 2018.
(Continued)

*Primary Examiner* — Adam J Eiseman
*Assistant Examiner* — Mohammed S. Alawadi
(74) *Attorney, Agent, or Firm* — McDermott Will & Emery LLP

(57) ABSTRACT

A part of kinetic energy during lowering of a slide of a press machine is converted into oil hydraulic energy by a first oil hydraulic cylinder, and the converted oil hydraulic energy (hydraulic oil having boosted first system pressure) is stored in a first accumulator. The hydraulic oil having the first system pressure stored in the first accumulator is discharged in knockout process, a second oil hydraulic cylinder that functions as a knockout cylinder is raised to perform knockout operation of a product worked by the press machine. Consequently, it is possible to perform knockout operation without using a dedicated driving source such as an oil pressure source and an air pressure source, and provide a low-cost hydraulic knockout device.

13 Claims, 10 Drawing Sheets

(51) Int. Cl.

| | |
|---|---|
| ***F15B 11/20*** | (2006.01) |
| ***F15B 1/02*** | (2006.01) |
| ***B21J 9/12*** | (2006.01) |
| ***F15B 21/042*** | (2019.01) |
| ***B30B 15/32*** | (2006.01) |

(52) U.S. Cl.
CPC ..... *F15B 11/20* (2013.01); *F15B 21/042* (2013.01); *F15B 2211/212* (2013.01); *F15B 2211/62* (2013.01)

(58) Field of Classification Search
CPC .. F15B 11/20; F15B 2211/62; F15B 2211/212
USPC ..... 72/355.6
See application file for complete search history.

(56) References Cited

U.S. PATENT DOCUMENTS

| | | | | |
|---|---|---|---|---|
| 5,038,598 | A * | 8/1991 | Pitzer | B21D 22/02 72/435 |
| 5,379,628 | A * | 1/1995 | Pahnke | B21J 9/12 100/269.07 |
| 6,178,803 | B1 * | 1/2001 | Ozaki | B30B 15/142 72/443 |
| 2009/0071218 | A1 * | 3/2009 | Kohno | B21D 24/08 72/351 |
| 2010/0043519 | A1 | 2/2010 | Schaltegger et al. | |
| 2011/0226141 | A1 | 9/2011 | Kohno | |
| 2011/0226161 | A1 | 9/2011 | Schumacher et al. | |
| 2015/0360274 | A1 * | 12/2015 | Kohno | B21D 24/14 72/20.2 |

FOREIGN PATENT DOCUMENTS

| | | | |
|---|---|---|---|
| EP | 3 100 799 | A1 | 12/2016 |
| EP | 3 115 119 | A1 | 1/2017 |
| GB | 2 006 654 | A | 5/1979 |
| JP | H05-237564 | A | 9/1993 |
| JP | H11-285897 | A | 10/1999 |
| JP | 2006-212668 | A | 8/2006 |
| JP | 2010-036225 | A | 2/2010 |
| JP | 2016-000407 | A | 1/2016 |

OTHER PUBLICATIONS

Office Action issued in Corresponding Japanese Patent Application No. 2017-013253, dated Jun. 20, 2018.

* cited by examiner

HYDRAULIC KNOCKOUT DEVICE

CROSS-REFERENCE TO RELATED APPLICATIONS

The present application claims priority under 35 U.S.C. § 119 to Japanese Patent Application No. 2017-013253, filed on Jan. 27, 2017. The above application is hereby expressly incorporated by reference, in its entirety, into the present application.

BACKGROUND OF THE INVENTION

Field of the Invention

The presently disclosed subject matter relates to a hydraulic knockout device for taking out a product press-worked by a press machine from the press machine.

Description of the Related Art

As a conventional this type of a hydraulic knockout device, an oil hydraulic knockout device that does not require a dedicated liquid pressure source (oil pressure source) for driving a knockout cylinder is proposed (Japanese Patent Application Laid-Open No. 11-285897).

An oil hydraulic knockout device described in Japanese Patent Application Laid-Open No. 11-285897 converts a part of kinetic energy during rising of a slide of a press machine into oil hydraulic energy to absorb the converted oil hydraulic energy, and uses (discharges) the absorbed oil hydraulic energy in knockout operation by a knockout cylinder through a knockout process (refer to FIG. 5 and claim 6 of Japanese Patent Application Laid-Open No. 11-285897).

Additionally, an oil hydraulic die cushion device having a function as an oil hydraulic knockout device that does not require a device such as an oil hydraulic pump which consumes power, and does not require a specific control device is proposed (Japanese Patent Application Laid-Open No. 2016-000407).

In the oil hydraulic die cushion device described in Japanese Patent Application Laid-Open No. 2016-000407, a part of kinetic energy during lowering of a slide of a press machine is converted into oil hydraulic energy by an oil hydraulic cylinder for a die cushion in a die cushion process of generating die cushion force to be absorbed, and the absorbed oil hydraulic energy is used in knockout operation by an oil hydraulic cylinder for a die cushion through a knockout process.

SUMMARY OF THE INVENTION

The oil hydraulic knockout device described in Japanese Patent Application Laid-Open No. 11-285897 discloses a rational idea of utilizing the kinetic energy of the press machine as power for knockout, but has a plurality of problems in that the kinetic energy is absorbed during rising of the slide.

<First Problem>

When a part of kinetic energy is converted into oil hydraulic energy during the rising of the slide to be absorbed, all vertical clearances (play) of respective portions of a press machine related to a connecting rod and a crank shaft approach a vertical downward side. On the other hand, during lowering of the slide including a press working process, a press load acts on the slide and the like, and therefore all the vertical clearances of the respective portions of the press machine approach a vertical upward side.

Therefore, in the vertical clearances of the respective portions of the press machine in one cycle of the press machine, clearances on the vertical downward side and clearances on the vertical upward side are generated. By change in the directions of the alternately generated clearances, the respective portions that generate the clearances repeat contact and non-contact to cause fretting (fretting corrosion).

<Second Problem>

In the invention described in Japanese Patent Application Laid-Open No. 11-285897, it is necessary to absorb kinetic energy during rising of the slide by an oil hydraulic pump motor connected to a crank shaft of the press machine through a gear, or absorb kinetic energy during rising of the slide by an oil hydraulic pump cylinder obtained by connecting a special balancer cylinder and a piston rod to a crank pin and the like of the crank shaft, the special balancer cylinder being formed with an oil hydraulic cylinder in a counter rod side chamber of the balancer cylinder disposed on the upper side of the slide. Therefore, a special mechanism is provided in a mechanism section that drives the press machine. Consequently, the press machine becomes a dedicated machine (special machine), which makes it difficult to post-install this function.

<Third Problem>

While a part of kinetic energy is converted into oil hydraulic energy to be absorbed during rising of the slide, and the absorbed energy of the pressure oil is utilized for rising operation of the knockout cylinder, it is necessary to provide an air source for return operation that makes the knockout cylinder after knockout operation perform return operation (Paragraph [0022] and FIG. 5 of Japanese Patent Application Laid-Open No. 11-285897). Additionally, pressure oil that flows in a rising side pressure generating chamber of the knockout cylinder is discharged to a tank in the return operation of the knockout cylinder, and therefore the energy of the pressure oil is not effectively utilized.

On the other hand, the oil hydraulic die cushion device described in Japanese Patent Application Laid-Open No. 2016-000407 does not function as a dedicated device for knockout, in a press machine that performs press working which does not require a die cushion process.

For example, the oil hydraulic cylinder for knockout does not serve as a function of waiting at a bottom dead center of the slide or less in the press working (slide lowering) process, and knocking out a product (lowering the bottom dead center of the slide or less to wait again before a next lowering process) in the slide rising process.

When this problem is broken down, the following two problems come to surface.

One is that an oil hydraulic driving source for enabling the oil hydraulic cylinder to perform rising/lowering operation singly is not present (even when an oil hydraulic cylinder dedicated for knockout is provided separately from an oil hydraulic cylinder dedicated for die cushion). A function of a low pressure side equivalent to a tank lacks, when a system pressure line is defined as a high pressure side.

Another is that if the oil hydraulic cylinder for die cushion is an oil hydraulic cylinder for a pump function (in addition to an oil hydraulic cylinder for knockout), the oil hydraulic cylinder for a die cushion cannot be returned to a (pump) initial position (raised) without discharging the absorbed energy of the pressure oil (in a state where pressure oil is preserved for knockout).

The presently disclosed subject matter has been made in view of such circumstances, and an object of the presently disclosed subject matter is to provide a functional hydraulic knockout device with a low cost without using a dedicated driving source such as an oil pressure source and an air pressure source.

In order to attain the above object, a hydraulic knockout device according to an aspect of the presently disclosed subject matter includes: an energy conversion section configured to convert a part of kinetic energy during lowering a slide of a press machine into hydraulic energy; an energy storage section configured to store the hydraulic energy converted by the energy conversion section; and a knockout section configured to knock out a product worked by the press machine, the knockout section configured to convert the hydraulic energy discharged from the energy storage section into kinetic energy to knock out the product.

According to the aspect of the presently disclosed subject matter, a part of the kinetic energy during the lowering of the slide of the press machine is converted into the hydraulic energy, and the converted hydraulic energy is stored in the energy storage section. The knockout section converts the hydraulic energy stored in the energy storage section into the kinetic energy in the knockout process, and performs the knockout operation of the product worked by the press machine (discharges the hydraulic energy stored in the energy storage section). Consequently, it is possible to perform the knockout operation without using a dedicated driving source such as an oil pressure source and an air pressure source, and provide a low-cost device. Additionally, a part of the kinetic energy during the lowering of the slide of the press machine is converted into the hydraulic energy to be used, and therefore there is no malfunction caused in a case where a part of the kinetic energy is converted into the oil hydraulic energy during the rising of the slide to be absorbed (problem of the above oil hydraulic knockout device described in Japanese Patent Application Laid-Open No. 11-285897).

In the hydraulic knockout device according to another aspect of the presently disclosed subject matter, the energy conversion section preferably includes: a cushion pin pressed down with lowering operation of the slide; and a first hydraulic cylinder having a piston rod which comes into contact with the cushion pin, and the energy storage section is preferably a first accumulator configured to store hydraulic fluid displaced from a rising side pressure generating chamber of the first hydraulic cylinder through the cushion pin when the slide is lowered, and the knockout section is preferably a second hydraulic cylinder having a rising side pressure generating chamber to which the hydraulic fluid stored in the first accumulator in knockout operation is fed.

The first hydraulic cylinder is used as the energy conversion section, so that a part of the kinetic energy during the lowering of the slide of the press machine can be efficiently converted into the hydraulic energy. Additionally, the hydraulic energy (hydraulic fluid) stored in the first accumulator is fed to the rising side pressure generating chamber of the second hydraulic cylinder that functions as the knockout section, so that it is possible to efficiently convert the hydraulic energy into the kinetic energy in the knockout operation.

The hydraulic knockout device according to further another aspect of the presently disclosed subject matter preferably further includes a second accumulator configured to store hydraulic fluid having second system pressure lower than hydraulic fluid having first system pressure stored in the first accumulator, wherein the second accumulator preferably stores hydraulic fluid displaced from a lowering side pressure generating chamber of the second hydraulic cylinder in the knockout operation, and feeds the hydraulic fluid to the rising side pressure generating chamber of the first hydraulic cylinder with rising of the slide to raise the cushion pin.

According to further another aspect of the presently disclosed subject matter, by using the hydraulic fluid having the first system pressure stored in the first accumulator, and the hydraulic fluid having the second system pressure stored in the second accumulator (the second system pressure is lower than the first system pressure), two types of operation, namely, the rising operation (knockout operation) and the lowering operation (return operation) of the second hydraulic cylinder for knockout can be performed, and the first hydraulic cylinder that converts the kinetic energy into the hydraulic energy can be caused to perform return operation with the rising of the slide.

The hydraulic knockout device according to further another aspect of the presently disclosed subject matter preferably further includes: a hydraulic closed circuit including the first hydraulic cylinder, the second hydraulic cylinder, the first accumulator, the second accumulator, a cushion pressure generating line connected to the rising side pressure generating chamber of the first hydraulic cylinder, a rising pressure generating line connected to the rising side pressure generating chamber of the second hydraulic cylinder, a lowering pressure generating line connected to the lowering side pressure generating chamber of the second hydraulic cylinder, a first system pressure line connected to the first accumulator, and a second system pressure line connected to the second accumulator; a first check valve that is disposed between the cushion pressure generating line and the first system pressure line, the first check valve configured to allow flow of hydraulic fluid from the cushion pressure generating line to the first system pressure line; a second check valve that is disposed between the cushion pressure generating line and the second system pressure line, the second check valve configured to allow flow of hydraulic fluid from the second system pressure line to the cushion pressure generating line; one or a plurality of first solenoid valves that are disposed between the rising pressure generating line and the first system pressure line, and between the rising pressure generating line and the second system pressure line, the one or a plurality of first solenoid valves configured to connect the rising pressure generating line to the first system pressure line in the knockout operation, and connect the rising pressure generating line to the second system pressure line after termination of the knockout operation; and one or a plurality of second solenoid valves that are disposed between the lowering pressure generating line and the first system pressure line, and between the lowering pressure generating line and the second system pressure line, the one or a plurality of second solenoid valves configured to connect the lowering pressure generating line to the second system pressure line in the knockout operation, and connect the lowering pressure generating line to the first system pressure line after termination of the knockout operation, wherein the hydraulic fluid is preferably pressurized and confined in the hydraulic closed circuit, hydraulic fluid in the first system pressure line is preferably pressurized only by the hydraulic fluid displaced from the rising side pressure generating chamber of the first hydraulic cylinder through the cushion pin during the lowering of the slide in one cycle period of the press machine.

According to further another aspect of the presently disclosed subject matter, the hydraulic fluid is pressurized and confined in the hydraulic closed circuit having the above configuration, and the hydraulic fluid do not need to be pressurized and fed in the hydraulic closed circuit in the one cycle period of the press machine. In other words, any dedicated driving source such as an oil pressure source and an air pressure source does not need to be used. Additionally, the first check valve that allows the flow of the hydraulic fluid from the cushion pressure generating line to the first system pressure line is disposed between the cushion pressure generating line and the first system pressure line, and the second check valve that allows the flow of the hydraulic fluid from the second system pressure line to the cushion pressure generating line is disposed between the cushion pressure generating line and the second system pressure line, but any solenoid valve is not disposed between these lines. Consequently, in a flow pass for storing the hydraulic fluid in the first accumulator, and a flow pass for feeding the hydraulic fluid in the second accumulator to the rising side pressure generating chamber of the first hydraulic cylinder, there is no leakage (leak) of the hydraulic fluid caused by the time of use of the solenoid valve. When a spool type solenoid valve is used, a leak of the hydraulic fluid is normally caused, and when a poppet type (non-leak type) solenoid valve is used, a leak of the hydraulic fluid is caused at the time of switching, and therefore the use of the solenoid valve should be minimized.

The hydraulic knockout device according to further another aspect of the presently disclosed subject matter preferably further includes: a hydraulic closed circuit including the first hydraulic cylinder, the second hydraulic cylinder, the first accumulator, the second accumulator, a cushion pressure generating line connected to the rising side pressure generating chamber of the first hydraulic cylinder, a rising pressure generating line connected to the rising side pressure generating chamber of the second hydraulic cylinder, a lowering pressure generating line connected to the lowering side pressure generating chamber of the second hydraulic cylinder, a first system pressure line connected to the first accumulator, and a second system pressure line connected to the second accumulator; a logic valve disposed between the cushion pressure generating line and the first system pressure line, the logic valve being a pilot driving type logic valve that uses first system pressure of the first system pressure line as pilot pressure so as to allow flow of hydraulic fluid from the cushion pressure generating line to the first system pressure line; a second check valve that is disposed between the cushion pressure generating line and the second system pressure line, and allows flow of hydraulic fluid from the second system pressure line to the cushion pressure generating line; one or a plurality of first solenoid valves that are disposed between the rising pressure generating line and the first system pressure line, and between the rising pressure generating line and the second system pressure line, connect the rising pressure generating line to the first system pressure line in the knockout operation, and connect the rising pressure generating line to the second system pressure line after termination of the knockout operation; and one or a plurality of second solenoid valves that are disposed between the lowering pressure generating line and the first system pressure line, and between the lowering pressure generating line and the second system pressure line, connect the lowering pressure generating line to the second system pressure line in the knockout operation, and connect the lowering pressure generating line to the first system pressure line after termination of the knockout operation, wherein the hydraulic fluid is preferably pressurized and confined in the hydraulic closed circuit, hydraulic fluid in the first system pressure line is preferably pressurized only by the hydraulic fluid displaced from the rising side pressure generating chamber of the first hydraulic cylinder through the cushion pin during the lowering of the slide in one cycle period of the press machine.

According to further another aspect of the presently disclosed subject matter, the pilot driving type logic valve is used in place of the first check valve. The logic valve functions similarly to the first check valve, and has a characteristic of facilitating design and attaining a lower cost since a working shape necessary for mounting on a hydraulic block (hydraulic manifold) is constant for each logic valve of each capacity (each allowable hydraulic fluid amount) (regardless of manufacturer of the logic valve).

In the hydraulic knockout device according to further another aspect of the presently disclosed subject matter, the first solenoid valve is a single (for example only one) solenoid valve configured to switch connection between the rising pressure generating line and the first system pressure line, or connection between the rising pressure generating line and the second system pressure line, and the second solenoid valve is a single (for example only one) solenoid valve configured to switch connection between the lowering pressure generating line and the first system pressure line, or connection between the lowering pressure generating line and the second system pressure line.

The first solenoid valve and the second solenoid valve are each composed of the single solenoid valve, and the direction of flow of the hydraulic fluid that flows in and out the rising side pressure generating chamber and the lowering side pressure generating chamber of the second hydraulic cylinder is switched by switching of the first solenoid valve and the second solenoid valve.

In the hydraulic knockout device according to further another aspect of the presently disclosed subject matter, the first solenoid valve includes a plurality of solenoid valves including a 1st-1 solenoid valve configured to switch connection or disconnection between the rising pressure generating line and the first system pressure line, and a 1st-2 solenoid valve configured to switch connection or disconnection between the rising pressure generating line and the second system pressure line, and the second solenoid valve includes a plurality of solenoid valves including a 2nd-1 solenoid valve configured to switch connection or disconnection between the lowering pressure generating line and the first system pressure line, and a 2nd-2 solenoid valve configured to switch connection or disconnection between the lowering pressure generating line and the second system pressure line.

Compared to a case where the first solenoid valve and the second solenoid valve are each composed of a single solenoid valve, while the number of the solenoid valves is increased, the second hydraulic cylinder can be stopped at a desirable position without applying a stopper by disconnecting a flow pass between both the pressure lines. Additionally, there are a lot of selectable types (large selection of goods) because the solenoid valves have (2-port type) simple configurations.

In the hydraulic knockout device according to further another aspect of the presently disclosed subject matter, the first solenoid valve and the second solenoid valve preferably each are a poppet type solenoid valve. In a steady state where the second hydraulic cylinder is stopped, the first system pressure line and the second system pressure line need to be disconnected in a non-leak state.

The hydraulic knockout device according to further another aspect of the presently disclosed subject matter further includes a controller configured to control the first solenoid valve and the second solenoid valve such that the second hydraulic cylinder is raised and thereafter lowered in a period from a time point when the slide of the press machine starts rising until a time point when the cushion pin starts lowering with lowering operation of the slide.

The hydraulic knockout device according to further another aspect of the presently disclosed subject matter preferably further includes a cooling device configured to cool hydraulic fluid in the hydraulic closed circuit. This is because temperature rise of the hydraulic fluid in the hydraulic closed circuit where pressurization and decompression are repeated is suppressed.

In the hydraulic knockout device according to further another aspect of the presently disclosed subject matter, oil feeding and system pressure confining throttle valves, or throttle valves and couplers are preferably mounted on the cushion pressure generating line, the first system pressure line, the second system pressure line, the rising pressure generating line, and the lowering pressure generating line. This is because the above throttle valves are each used as an inlet and an outlet of hydraulic fluid when the hydraulic fluid is pressurized and confined in the hydraulic closed circuit by an external liquid feeding device.

In the hydraulic knockout device according to further another aspect of the presently disclosed subject matter, a liquid feeding device includes: a tank configured to store the hydraulic fluid; a discharge port configured to feed the hydraulic fluid to the hydraulic closed circuit; a return port to which the hydraulic fluid is returned from the hydraulic closed circuit, the return port being connected to the tank; and a hydraulic pump configured to feed the hydraulic fluid from the tank to the hydraulic closed circuit through the discharge port, and the hydraulic pump is preferably driven only when the hydraulic pump pressurizes and confines the hydraulic fluid in the hydraulic closed circuit. The liquid feeding device is an external device that is detachably attached to the hydraulic knockout device, and is connected to the hydraulic closed circuit only when the hydraulic fluid is pressurized and confined. This liquid feeding device do not need to be attached to each hydraulic knockout device, and a single liquid feeding device only needs to be prepared for a plurality of the hydraulic knockout devices to be controlled.

In the hydraulic knockout device according to further another aspect of the presently disclosed subject matter, an extension hose connected to at least one of the discharge port and the return port is attached to the liquid feeding device, and a coupler is provided in each of both ends of the extension hose. Consequently, the discharge port and the return port of the liquid feeding device can be connected to the hydraulic closed circuit through the extension hose in a case where the discharge port and the return port cannot be directly connected to the hydraulic closed circuit.

In the hydraulic knockout device according to further another aspect of the presently disclosed subject matter, a plurality of the first hydraulic cylinders are preferably disposed, and respective rising side pressure generating chambers are preferably communicated with each other. Load to the slide can be equalized by disposing of a plurality of the first hydraulic cylinders.

In the hydraulic knockout device according to further another aspect of the presently disclosed subject matter, on a lower surface of the slide, a press-down member that presses down the cushion pin, or an upper die including a press-down member that presses down the cushion pin is preferably mounted. The press-down member that presses down the first hydraulic cylinder through the cushion pin may be a member mounted on the lower surface of the slide, or may be provided in an upper die mounted on the lower surface of the slide.

In the hydraulic knockout device according to further another aspect of the presently disclosed subject matter, the cushion pin is preferably inserted into a cushion pin hole formed in a bolster of the press machine, and is detached from the bolster at a time of press working which does not require knockout operation.

In the case of the press working (die) which does not require the knockout operation, when the cushion pin is detached, the first hydraulic cylinder can be made not to function (to stop pumping action of the first hydraulic cylinder), and energy of the press machine is unnecessarily absorbed. Additionally, mounting on a bed section (or lower surface of a bolster) without remodeling (the mechanical section of) the press machine is possible similarly to a conventional hydraulic knockout device, and post-installation is facilitated.

According to the presently disclosed subject matter, a part of the kinetic energy during the lowering of the slide of the press machine is converted into the hydraulic energy to be stored, and the stored hydraulic energy is converted into kinetic energy in the knockout process, and the knockout operation for the product is performed, and therefore it is possible to attain a functional hydraulic knockout device with a low cost without using a dedicated driving source such as an oil pressure source and an air pressure source.

DETAILED DESCRIPTION OF THE EMBODIMENTS

Hereinafter, preferred embodiments of a hydraulic knockout device according to the presently disclosed subject matter will be described with reference to the attached drawings.

Configuration of Hydraulic Knockout Device of First Embodiment

Figure 1:
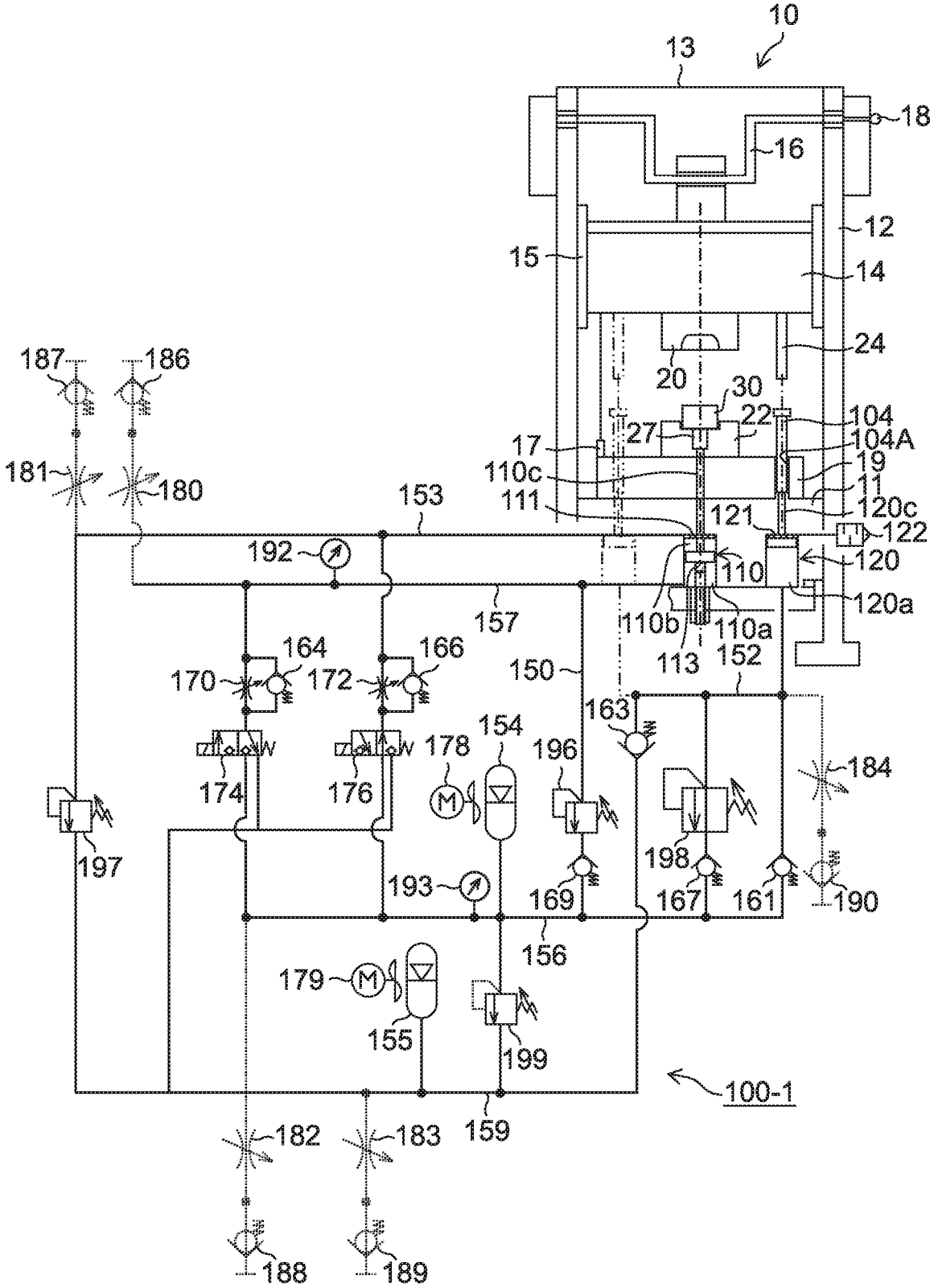
FIG. 1 is a configuration diagram illustrating a first embodiment of an oil hydraulic knockout device.

FIG. 1 is a configuration diagram illustrating a first embodiment of a hydraulic knockout device according to the presently disclosed subject matter.

In FIG. 1, a hydraulic knockout device (hereinafter, referred to as an "oil hydraulic knockout device") 100-1 is capable of being post-installed without remodeling (a mechanical section of) an existing press machine.

In a press machine 10 illustrated in FIG. 1, a frame includes a bed 11, a column 12, and a crown 13, a slide 14 is movably guided in the vertical direction by a slide guide 15 provided in the column 12. The slide 14 is moved in the vertical direction on FIG. 1 by a crank mechanism including a servo motor (not illustrated), or a crank shaft 16 to which rotation driving force is transmitted by a flywheel (not illustrated).

It is desirable that a slide position detector 17 which detects a position of the slide 14 is provided on the bed 11 side of the press machine 10, or a crank shaft encoder 18 which detects the angle of the crank shaft 16 is provided in the crank shaft 16.

An upper die 20 and a press-down member 24 are mounted on the slide 14, and a lower die 22 is mounted on a bolster 19 of the bed 11. The press-down member 24 may be an independent member mounted on a lower surface of the slide 14, or may be a member provided in the upper die 20 mounted on the lower surface of the slide 14.

A material 30 is set on the upper side of the lower die 22, and is press-worked by this press machine 10.

The oil hydraulic knockout device 100-1 of the first embodiment includes the press-down member 24, a cushion pin 104, a first oil hydraulic cylinder (first hydraulic cylinder) 120, a second oil hydraulic cylinder (second hydraulic cylinder) 110, a rising side pressure generating chamber 120*a* of the first oil hydraulic cylinder 120, an oil hydraulic closed circuit (hydraulic closed circuit) 150 connected to a rising side pressure generating chamber 110*a* and a lowering side pressure generating chamber 110*b* of the second oil hydraulic cylinder 110.

Figure 2:
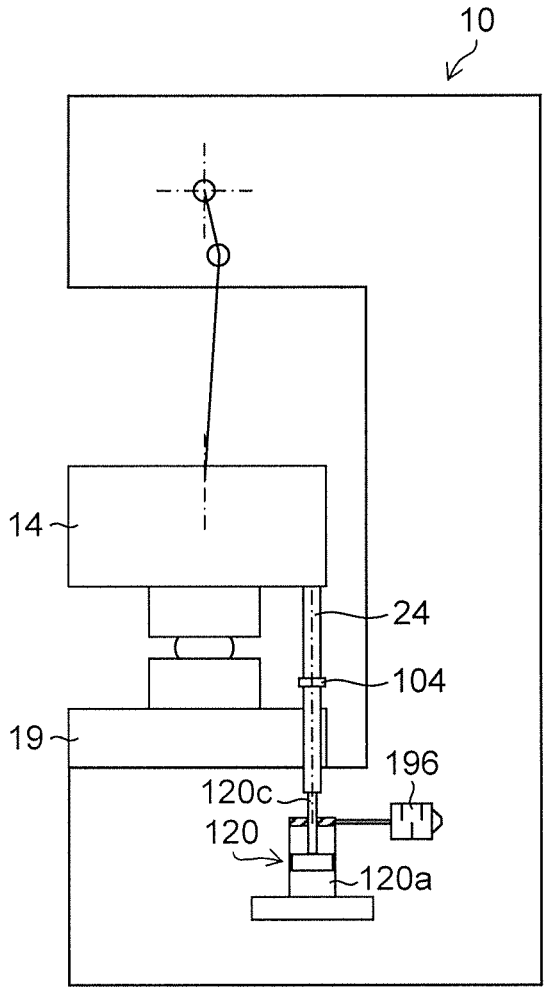
FIG. 2 is a view illustrating a layout example of a cushion pin in a press machine having a C-shaped frame.

It is desirable that the cushion pin 104 is disposed at an outside polygonal position (for example, a left front and right rear position, or a right front and left rear position) of a bolster area in which the press-down member 24 is unlikely to obstruct and is likely to secure load balance of the press machine when various dies are attached and detached. Alternatively, it is desirable that, for example, in a case where the cushion pin 104 is mounted on the press machine 10 having the C-shaped frame in which the front side of the press machine 10 is open as illustrated in FIG. 2, the cushion pin 104 is disposed at a rear left and right position of the bolster area in which an opening deformation amount of the frame is minimum, and the load balance of the press machine 10 is likely to be secured.

The cushion pin 104 of this embodiment is inserted into a cushion pin hole 104A formed in the bolster 19 of the press machine 10, the press-down member 24 that lowers with lowering operation of the slide 14 can come into contact with an upper end of the cushion pin 104, and a lower end of the cushion pin 104 comes into contact with a piston rod 120*c* of the first oil hydraulic cylinder 120. In other words, the first oil hydraulic cylinder 120 is disposed just below the cushion pin 104.

The cushion pin 104 is preferably detached from the bolster 19 during press working of a product which does not require knockout operation. This is because in a case of the press working (die) with no knockout operation, when the cushion pin 104 is detached, the first oil hydraulic cylinder 120 can be made not to function, and it is possible to prevent unnecessary absorption of a part of kinetic energy of the press machine 10.

A plurality of the first oil hydraulic cylinders 120 can be disposed. In a case where the plurality of first oil hydraulic cylinders 120 are disposed, it goes without saying that a plurality of the press-down members 24 and a plurality of the cushion pins 104 also need to be disposed. In a case where the plurality of first oil hydraulic cylinders 120 are disposed, the respective rising side pressure generating chambers 120*a* of the first oil hydraulic cylinders 120 are communicated with each other. Consequently, the plurality of first oil hydraulic cylinders 120 can be treated as a substantially single first oil hydraulic cylinder.

In a case where the press-down member 24 does not obstruct when various dies are attached and detached, the press-down member 24 may be permanently installed in the slide 14. In a case where the press-down member 24 obstructs depending on the type of the die, each die only needs to be attached and detached independently. In this embodiment, the die is regarded as a part of the upper die 20.

The first oil hydraulic cylinder 120 functions as an energy conversion section (charging cylinder) that converts a part of kinetic energy during lowering of the slide 14 of the press machine 10 into oil hydraulic (hydraulic) energy, and when the press-down member 24 that lowers with the lowering operation of the slide 14 comes into contact with the cushion pin 104, and the piston rod 120*c* is pressed down through the cushion pin 104, the first oil hydraulic cylinder 120 displaces hydraulic oil (hydraulic fluid) in the rising side pressure generating chamber 120*a*.

Reference numeral 121 designates an upper limit stopper of the first oil hydraulic cylinder 120, and reference numeral 122 designates a silencer.

The second oil hydraulic cylinder 110 functions as a knockout section (knockout cylinder) for taking out a product press-worked by the press machine 10 from the die, and raises or lowers a piston rod 110*c* by differential pressure between hydraulic oil in the rising side pressure generating chamber 110*a* of the second oil hydraulic cylinder 110 and hydraulic oil in the lowering side pressure generating chamber 110*b*. In the second oil hydraulic cylinder 110, a knockout pin 27 disposed in a through hole in the lower die 22 is raised by rising of the piston rod 110*c*, and presses up a product on the lower die 22, thereby enabling knockout action of the product.

Reference numeral 111 designates an upper limit stopper of the second oil hydraulic cylinder 110, and reference numeral 113 designates a lower limit stopper of the second oil hydraulic cylinder 110 (manually adjustable lower limit stopper capable of adjusting a height by a screw). After the knockout action, although not illustrated, a product carrying-out device holds the product, and carries out the product to a subsequent process.

[Oil Hydraulic Closed Circuit]

Now, a configuration of the oil hydraulic closed circuit 150 that drives each of the first oil hydraulic cylinder 120 and the second oil hydraulic cylinder 110 will be described.

The oil hydraulic closed circuit 150 includes the first oil hydraulic cylinder 120 (rising side pressure generating chamber 120*a*), the second oil hydraulic cylinder 110 (the rising side pressure generating chamber 110*a* and the lowering side pressure generating chamber 110*b*), a first accumulator 154 that functions as an energy storage section, a second accumulator 155, a cushion pressure generating line 152 connected to the rising side pressure generating chamber 120*a* of the first oil hydraulic cylinder 120, a rising pressure generating line 157 connected to the rising side pressure generating chamber 110*a* of the second oil hydraulic cylinder 110, a lowering pressure generating line 153 connected to the lowering side pressure generating chamber 110*b* of the second oil hydraulic cylinder 110, a first system pressure line 156 connected to the first accumulator 154, and a second system pressure line 159 connected to the second accumulator 155.

To the first system pressure line 156, the first accumulator 154 that has higher pressure than the second system pressure line 159, and confines gas pressure of about 20 to 150 kg/cm$^2$ therein. The first accumulator 154 serves as a power source for raising and lowering the second oil hydraulic cylinder 110, and hydraulic oil having substantially constant first system pressure of about 40 to 250 kg/cm$^2$ is filled in the first accumulator 154 previously (before machine operation).

In a case where the cushion pin 104 is inserted into the cushion pin hole 104A of the bolster 19, the press-down member 24 that lowers with lowering operation of the slide 14 presses down the piston rod 120*c* of the first oil hydraulic cylinder 120 through the cushion pin 104 in a process of a final stage (cushion process) of reaching a bottom dead center in the lowering process of the slide 14 of the press machine 10. The hydraulic oil displaced from the rising side pressure generating chamber 120*a* of the first oil hydraulic cylinder 120 by pressing down of the piston rod 120*c* is stored in the first accumulator 154 from the cushion pressure generating line 152 through a below described first check valve 161 and the first system pressure line 156. The first oil hydraulic cylinder 120 performs pumping action in this cushion process, so that hydraulic oil having the above first system pressure is generated.

To the second system pressure line 159, the second accumulator 155 that confines gas pressure of about 1 to 5 kg/cm$^2$ therein is connected. The second accumulator 155 serves as a tank, and hydraulic oil having substantially constant second system pressure of about 3 to 15 kg/cm$^2$, which is lower pressure than the first system pressure, is filled in the second accumulator 155 previously (before machine operation).

The first check valve 161 that allows flow of hydraulic oil from the cushion pressure generating line 152 to the first system pressure line 156 is disposed between the cushion pressure generating line 152 and the first system pressure line 156, and the second check valve 163 that allows flow of hydraulic oil from the second system pressure line 159 to the cushion pressure generating line 152 is disposed between the cushion pressure generating line 152 and the second system pressure line 159.

A first solenoid valve 174 is disposed between the rising pressure generating line 157 and the first system pressure line 156, and between the rising pressure generating line 157 and the second system pressure line 159, and a second solenoid valve 176 is disposed between the lowering pressure generating line 153 and the first system pressure line 156, and between the lowering pressure generating line 153 and the second system pressure line 159.

The first solenoid valve 174 is a 3-port poppet type solenoid valve that switches connection between the rising pressure generating line 157 and the first system pressure line 156 or connection between the rising pressure generating line 157 and the second system pressure line 159 by turning on/off the first solenoid valve 174.

The first solenoid valve 174 connects the rising pressure generating line 157 to the first system pressure line 156 in knockout operation (when the first solenoid valve 174 is turned on), and the hydraulic oil of the first system pressure stored in the first accumulator 154 is fed to the rising pressure generating line 157 through the first system pressure line 156, the first solenoid valve 174, and a throttle valve 170, and is fed to the rising side pressure generating chamber 110*a* of the second oil hydraulic cylinder 110 through the rising pressure generating line 157. Additionally, the first solenoid valve 174 connects the rising pressure generating line 157 and the second system pressure line 159 after termination of the knockout operation (when the first solenoid valve 174 is turned off), and the hydraulic oil in the rising side pressure generating chamber 110*a* of the second oil hydraulic cylinder 110 is exhausted to the rising pressure generating line 157, a check valve 164, the first solenoid valve 174, and the second system pressure line 159 (second accumulator 155).

Similarly, the second solenoid valve 176 is a 3-port poppet type solenoid valve that switches connection between the lowering pressure generating line 153 and the first system pressure line 156 or connection between the lowering pressure generating line 153 and the second system pressure line 159 by turning on/off the second solenoid valve 176.

The second solenoid valve 176 connects the lowering pressure generating line 153 to the second system pressure line 159 in knockout operation (when the second solenoid valve 176 is turned on), and the hydraulic oil in the lowering side pressure generating chamber 110*b* of the second oil hydraulic cylinder 110 is exhausted to the lowering pressure generating line 153, a check valve 166, and the second system pressure line 159 (second accumulator 155). Additionally, the second solenoid valve 176 connects the lowering pressure generating line 153 to the first system pressure line 156 after termination of the knockout operation (when the second solenoid valve 176 is turned off), and the hydraulic oil of the first system pressure is fed from the first accumulator 154 to the lowering side pressure generating chamber 110*b* of the second oil hydraulic cylinder 110 through the first system pressure line 156, the second solenoid valve 176, a throttle valve 172, and the lowering pressure generating line 153.

Specifically, when the first solenoid valve 174 and the second solenoid valve 176 are each turned on, the pressure of the rising side pressure generating chamber 110*a* of the second oil hydraulic cylinder 110 becomes the first system pressure, the pressure of the lowering side pressure generating chamber 110*b* becomes the second system pressure, and the second oil hydraulic cylinder 110 rises due to a pressure difference between the first system pressure and the second system pressure, and is stopped by the upper limit stopper 111. The rising speed (knockout speed) of this second oil hydraulic cylinder 110 is possible by adjusting the throttle valve 170. At this time, the hydraulic oil exhausted from the lowering pressure generating line 153 to the second system pressure line 159 passes the check valve 166 without passing the throttle valve 172 (without consuming waste energy due to passing of the throttle valve 172).

When the first solenoid valve 174 and the second solenoid valve 176 are each turned off, the pressure of the rising side pressure generating chamber 110*a* of the second oil hydraulic cylinder 110 becomes the second system pressure, the pressure of the lowering side pressure generating chamber 110*b* becomes the first system pressure, and the second oil hydraulic cylinder 110 lowers due to a pressure difference between the first system pressure and the second system pressure, and is stopped by the lower limit stopper 113. The lowering speed of the second oil hydraulic cylinder 110 is possible by adjusting the throttle valve 172. At this time, the hydraulic oil exhausted from the rising pressure generating line 157 to the second system pressure line 159 passes the check valve 164 without passing the throttle valve 170 (without consuming waste energy due to passing of the throttle valve 170).

Relief valves 196, 197, 198, and 199 function as safety valves of respective lines, and relief pressure slightly higher than action (estimation) pressure of each line is set. The check valves 167 and 169 prevent the first system pressure from flowing back to the rising pressure generating line 157 of the second oil hydraulic cylinder 110 and the cushion pressure generating line 152 through the relief valves 196, 198, respectively.

The rising pressure generating line 157, the lowering pressure generating line 153, the first system pressure line 156, the second system pressure line 159, and the cushion pressure generating line 152 are mounted with oil feeding (liquid feeding) and system pressure confining throttle valves (needle valves) 180, 181, 182, 183, 184, and couplers 186, 187, 188, 189, 190, respectively.

Furthermore, cooling devices 178, 179 that send air to the first accumulator 154 and the second accumulator 155 having large surface areas, and cool the first accumulator 154 and second accumulator 155 (hydraulic oil), respectively are provided. Each of the cooling devices 178, 179 is an air-cooled cooling device by a fan, but is not limited to this, and may be a water-cooled cooling device that circulates cooling water to cool hydraulic oil. In a case where the use frequency of the oil hydraulic knockout device 100-1 is low, mere natural heat radiation can attain cooling without providing any cooling device, and a more inexpensive device can be attained.

In the rising pressure generating line 157 and the first system pressure line 156, pressure detectors 192, 193 are provided in order to confirm the pressure of the respective lines.

[Oil Feeder (Liquid Feeding Device)]

Now, an oil feeder will be described.

Figure 3:
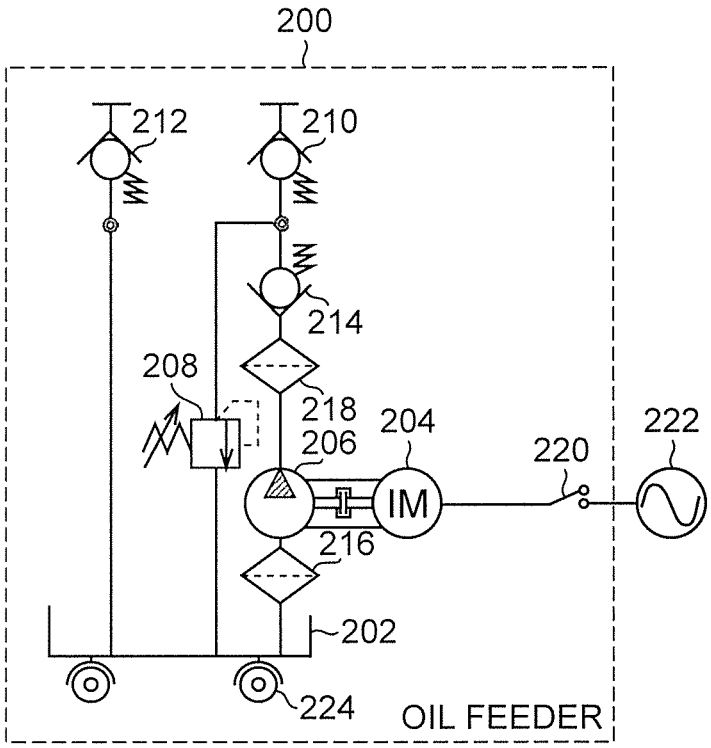
FIG. 3 is a configuration diagram illustrating an embodiment of an oil feeder.

FIG. 3 is a configuration diagram illustrating an embodiment of the oil feeder.

An oil feeder 200 is used at the time of oil feeding and system pressure confining, or system depressurizing (setup preparation), and is not used at the time of a cycle function (normal function) of the oil hydraulic knockout device 100-1.

Therefore, the oil feeder 200 does not need to be attached to each oil hydraulic knockout device 100-1, and a single liquid feeding device only needs to be prepared for a plurality of the oil hydraulic knockout device 100-1 to be controlled.

As illustrated in FIG. 3, the oil feeder 200 includes a tank 202 that stores hydraulic oil, an oil hydraulic pump (hydraulic pump) 206 that is driven by an induction motor 204, a relief valve 208 that functions as a safety valve, a discharge side coupler 210 (discharge port), a return side coupler 212 (return port), a check valve 214, and filters 216, 218.

The couplers 210, 212 of the oil feeder 200 are connected to any two of the five couplers 186, 187, 188, 189, 190 provided in the rising pressure generating line 157, the lowering pressure generating line 153, the first system pressure line 156, the second system pressure line 159, and the cushion pressure generating line 152 of the oil hydraulic closed circuit 150, respectively.

Figure 4:
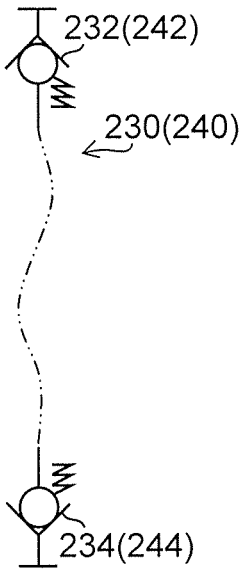
FIG. 4 is a view illustrating an extension hose connecting an oil hydraulic closed circuit to the oil feeder.

In a case where the couplers 210, 212 of the oil feeder 200 cannot be connected to any two of the five couplers 186, 187, 188, 189, 190 of the oil hydraulic closed circuit 150, the couplers 210, 212 are connected through one or two extension hose 230 (extension hose 240) illustrated in FIG. 4.

The extension hose 230 (240) includes a coupler 232 (242) and a coupler 234 (244) on both ends, and the coupler 210 or 212 on the oil feeder side can be connected to the coupler 186, 187, 188, 189 or 190 on the oil hydraulic closed circuit side.

When a switch 220 is turned on, the induction motor 204 of the oil feeder 200 is driven by an alternating current from an AC power source 222, and rotates the oil hydraulic pump 206. Consequently, hydraulic oil in the tank 202 can be fed to the oil hydraulic closed circuit 150 of the oil hydraulic knockout device 100-1 through the filters 216, 218, the check valve 214, and the coupler 210 (or the coupler 210 and the extension hose 230), and the hydraulic oil can be returned to the tank 202 from the oil hydraulic closed circuit 150 through the coupler 212 (or the coupler 212 and the extension hose 230).

The oil feeder 200 is provided with a caster 224 on the lower surface, and is easily movable.

<Flushing, Oil Feeding and Depressurize>

In order to enable use of the oil hydraulic knockout device 100-1 of this embodiment, preparation and setup work for pressurizing and confining hydraulic oil in the oil hydraulic closed circuit 150 by using the oil feeder 200 needs to be performed.

First, flushing work for circulating hydraulic oil inside the oil hydraulic closed circuit 150, removing contaminations inside the oil hydraulic closed circuit 150, and bleeding air is performed. The flushing work is performed while any two of the couplers 186, 187, 188, 189, 190 disposed in the respective lines in the oil hydraulic closed circuit 150 are connected to the coupler 210 on the discharge side of the oil feeder 200, and the coupler 212 on the return side, and several connecting points are changed.

Figure 5:
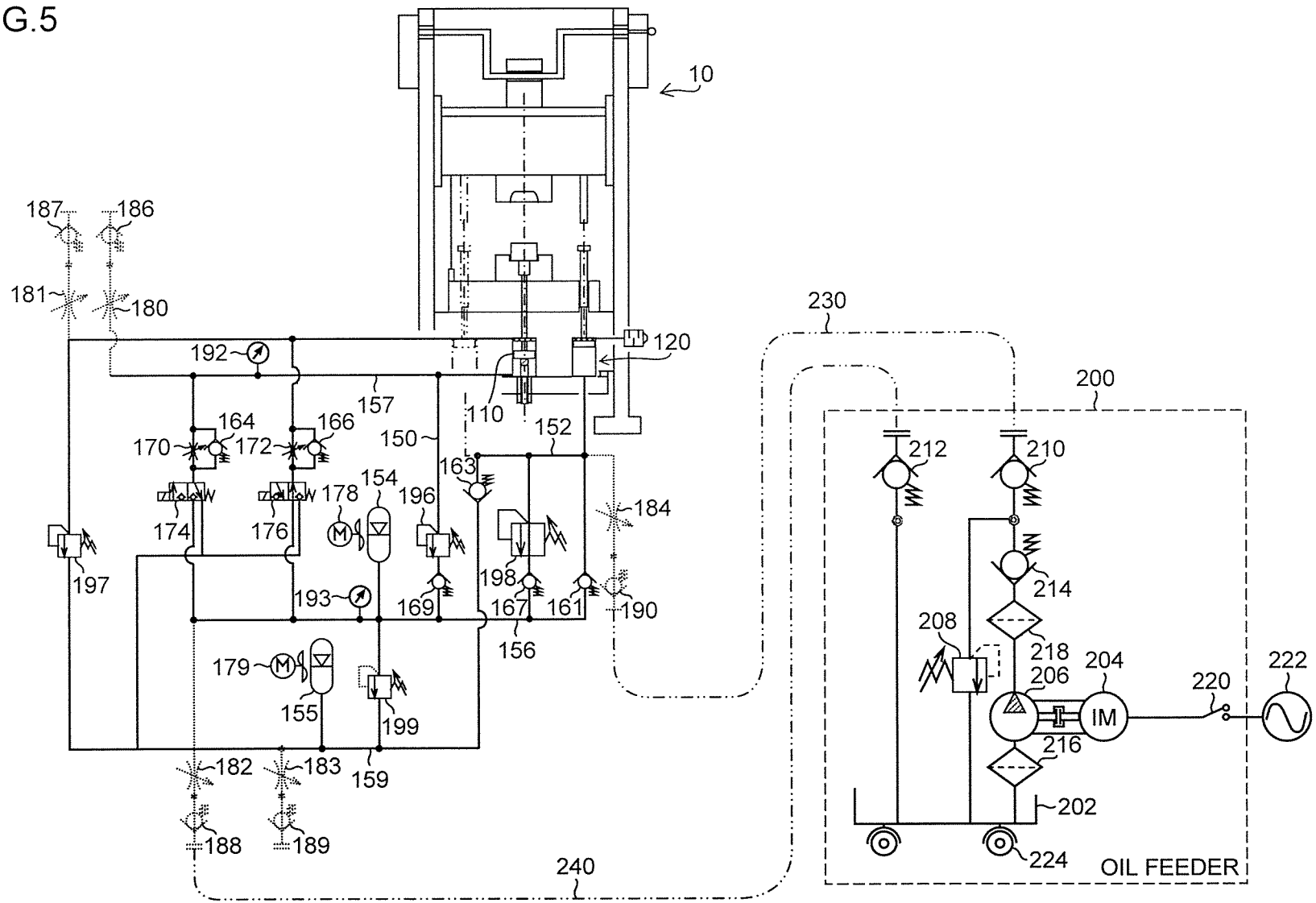
FIG. 5 is a diagram illustrating a state where the oil hydraulic closed circuit and the oil feeder are connected to each other through the extension hose.

For example, in FIG. 5, in a case where flushing of the first system pressure line 156 and the cushion pressure generating line 152 in the oil hydraulic closed circuit 150 is particularly performed, the coupler 210 on the discharge side of the oil feeder 200 is connected to the coupler 190 of the cushion pressure generating line 152, and the coupler 188 of the first system pressure line 156 is connected to the coupler 212 on the return side of the oil feeder 200, and all the throttle valves 182, 184 between these are full opened.

When the flushing is completed, contaminations are removed, and hydraulic oil of atmospheric pressure is filled in the oil hydraulic closed circuit 150. The flushing work only needs to be performed once after the device is manufactured (at startup of the device).

Then, oil feeding to the oil hydraulic closed circuit 150 is performed. A single (one pattern) oil feeding method (route) is basically determined for each device (for each oil hydraulic closed circuit 150). In the case of FIG. 5, in a state where the cushion pin 104 is not inserted (or the slide 14 is at a top dead center), hydraulic oil having predetermined pressure is fed to each of the first system pressure line 156 and the second system pressure line 159, separately.

The relief valve 199 acts as a safety valve, and relief pressure sufficiently higher than the first system pressure of the first system pressure line 156 is set, and therefore in a case where hydraulic oil of predetermined first system pressure is fed to the first system pressure line 156, oil cannot be fed to the second system pressure line 159 through the relief valve 199 at the same time.

During the oil feeding of the hydraulic oil having the first system pressure, the second oil hydraulic cylinder 110 is pressed against the lower limit (lower limit stopper 113 position).

During the oil feeding of hydraulic oil having the second system pressure, the first oil hydraulic cylinder 120 rises up to a position where the upper limit stopper 121 acts. After the first oil hydraulic cylinder 120 rises, the second system pressure is stabilized at a predetermined value (vicinity), and thereafter oil feeding to the second system pressure line 159 is terminated.

The oil feeding only needs to be basically performed once (does not need to be performed for each die replacement work).

In this embodiment, at a time point of oil feeding completion, the first system pressure is about 51 kg/cm$^2$, and the second system pressure is 8 kg/cm$^2$.

[Controller]

Figure 6:
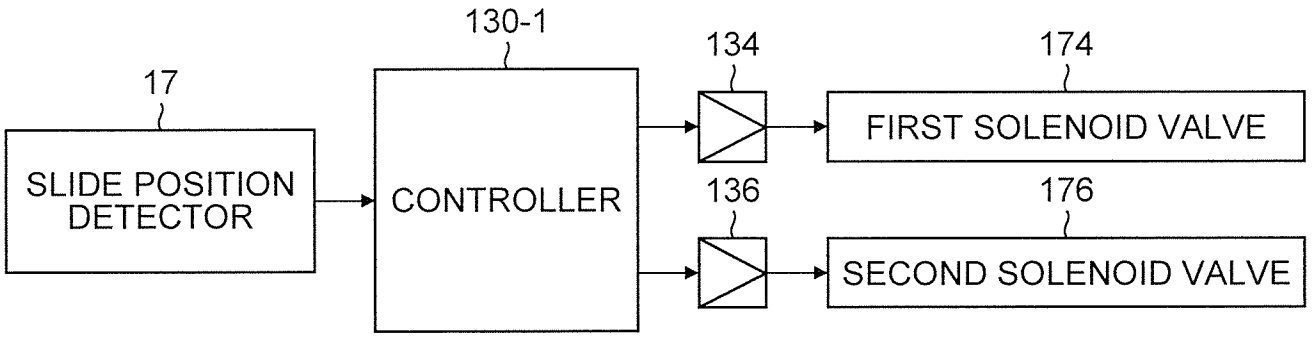
FIG. 6 is a block diagram illustrating the first embodiment of a controller applied to the hydraulic knockout device of the first embodiment.

FIG. 6 is a block diagram illustrating a controller 130-1 applied to the oil hydraulic knockout device 100-1 of the first embodiment.

The controller 130-1 illustrated in FIG. 6 is a controller for on/off-controlling the first solenoid valve 174 and the second solenoid valve 176 of the oil hydraulic closed circuit 150 illustrated in FIG. 1, and on/off-controls relays 134, 136 in accordance with position signal of the slide 14 detected by the slide position detector 17, outputs a driving current to each of solenoids of the first solenoid valve 174 and the second solenoid valve 176 through the relays 134, 136 that are on/off-controlled, and on/off-controls the first solenoid valve 174 and the second solenoid valve 176 individually.

The controller 130-1 of this embodiment performs simple control such as individual on/off-control of the first solenoid valve 174 and the second solenoid valve 176, does not need a special control device, and thereafter can use a part of the controller of the press machine 10 (PLC: programmable logic controller), and does not cause increase in the cost of the oil hydraulic knockout device 100-1.

The specific timing of the on/off-control of the first solenoid valve 174 and the second solenoid valve 176 by the controller 130-1 will be described below. The controller 130-1 may on/off-control the first solenoid valve 174 and the second solenoid valve 176 in accordance with the angle of the crank shaft 16 (position of the slide 14 calculated from an angle) detected by the crank shaft encoder 18.

[Knockout Control]

<Press Lowering Process of First Cycle>

Figure 7:
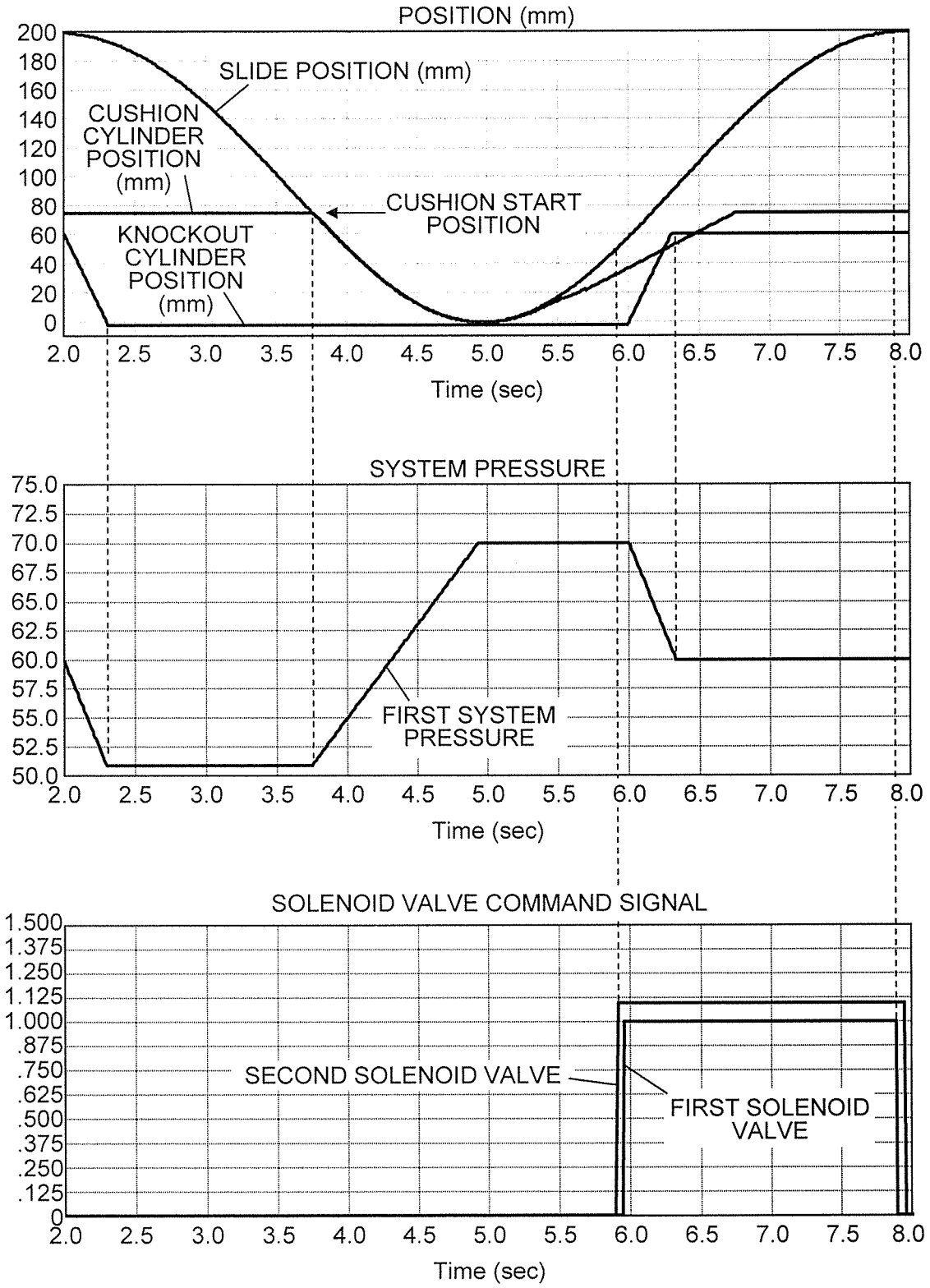
FIG. 7 is a waveform chart illustrating a state of each portion in one cycle of a second cycle and a subsequent cycle after start of operation of the press machine and the oil hydraulic knockout device of the first embodiment.

FIG. 7 is a waveform chart illustrating a state of each portion in one cycle of a second cycle and a subsequent cycle after start of operation of the press machine 10 and the oil hydraulic knockout device 100-1 of the first embodiment.

In a graph at an upper stage of FIG. 7, a position of the slide 14 (slide position), a position of the first oil hydraulic cylinder 120 (cushion cylinder position), and a position of the second oil hydraulic cylinder 110 (knockout cylinder position) that change during one cycle are illustrated.

In a graph at a middle stage of FIG. 7, the first system pressure that changes during one cycle is illustrated, and in a graph at a lower stage of FIG. 7, respective solenoid valve command signals for turning on/off the first solenoid valve 174 and the second solenoid valve 176 are illustrated.

In FIG. 7, illustration of a first cycle is omitted, but at an operation start time point, the press/slide is at the top dead center, the second oil hydraulic cylinder 110 (hereinafter referred to as a "knockout cylinder 110") is at the (press) bottom dead center (vicinity (slightly below the bottom dead center)). The first system pressure acts on the lowering pressure generating line 153 of the knockout cylinder 110 through the second solenoid valve 176 in an OFF state, and the second system pressure equivalent to tank pressure acts on the rising pressure generating line 157 through the first solenoid valve 174 on an OFF state. Consequently, lowering force acts on the knockout cylinder 110, and the knockout cylinder 110 is at a lower setting position slightly below the bottom dead center in a state where the manually adjustable lower limit stopper 113 is pressed against the knockout cylinder 110.

It is preferable that the lower limit stopper 113 of the knockout cylinder 110 is manually adjusted according to every die, or every knockout stroke.

In this embodiment, the lower limit stopper 113 has a rod-like lower end that is screw-cut, and employs a system for performing adjustment by manually rotating a nut member screwed with the screw to determine a lower limit position. The lower limit stopper 113 can employ an automatically adjustable system with respect to the lower setting position by driving rotation of a nut member with a motor.

The first system pressure is about 51 kg/cm$^2$. The material 30 is set on the lower die 22.

The second system pressure acts on the cushion pressure generating line 152 of the first oil hydraulic cylinder 120 (hereinafter referred to as a "cushion cylinder 120") through the second check valve 163, and the cushion cylinder 120 is in a state of being pressed against the upper limit stopper 121 (upper limit position).

When the press/slide reaches a cushion start position, the slide 14 presses the piston rod 120*c* of the cushion cylinder 120 through the press-down member 24 and the cushion pin 104, and hydraulic oil of the cushion pressure generating line 152 is displaced to the first system pressure line 156 through the first check valve 161. At this time, the pressure of the first system pressure line (pressure of the oil hydraulic of the first accumulator 154) rises up to 70 kg/cm2 by a stored amount of the hydraulic oil, and maintains a maximum value during the cycle. This (action) is performed immediately after the above, and is favorable to knockout action requiring knockout force (by the knockout cylinder 110).

Thus, during lowering of the press/slide, a part of kinetic energy of the press is absorbed as energy of pressure oil.

The press forming is performed at this time (during this), and therefore a play (clearance) section previously pressed to one direction side (comes into contact at the time of forming) by the balancer cylinder is more firmly pressed in one direction to accomplish forming. The cushion cylinder 120 also serves for further stabilizing action of stabilizing vibration behavior which is likely to be generated by play at the time of forming start.

<Press Rising Process>

When the slide 14 starts rising from the bottom dead center, and the press-down member 24 is separated from the cushion pin 104, the cushion pressure generating line 152 on which pressure slightly larger than the first system pressure (larger by the cracking pressure of the first check valve 161) acts is released by the amount corresponding to the elastic compression, and the second system pressure of the second system pressure line 159 acts on the cushion pressure generating line 152 through the second check valve 163, and the cushion cylinder 120 rises at a low speed.

The movable mass of the cushion cylinder 120 is limited to the piston rod 120*c* and the cushion pin 104, and is relatively low inertia, and therefore when relatively small second system pressure of about 8 kg/cm$^2$ acts, the cushion cylinder 120 can rise at a relatively slow speed (slowly). In this embodiment, at a time point when the press/slide half rises, the cushion cylinder 120 acts on the upper limit stopper 121 (returns to an initial position). The cushion cylinder 120 only needs to be able to return to the initial position before the slide 14 reaches the cushion start position in a next cycle of press/slide lowering process at the latest.

The controller 130-1 turns on the second solenoid valve 176 at a time point when the slide reaches (rises) 50 mm, and turns on the first solenoid valve 174, 0.06 seconds behind. Thus, after the second system pressure is made to act on the lowering pressure generating line 153 of the knockout cylinder 110, the first system pressure is made to act on the rising pressure generating line 157, so that no surge generates in the rising pressure generating line 157 or the lowering pressure generating line 153 at operation start, and the knockout cylinder 110 performs knockout action for a product while rising up to a position where the upper limit stopper 111 acts, at a time point when the slide 14 reaches about 60 mm.

The first system pressure lowers up to about 60 kg/cm$^2$ by an amount of the knockout operation. Here, the knockout speed is adjustable by adjustment of the throttle valve 170.

After the knockout action, although not illustrated, the product carrying-out device holds the product, and carries out the product to a subsequent process. During this, the slide 14 is coming to almost a final stage of the rising process.

<Lowering Process of Second Cycle and Subsequent Cycle>

The controller 130-1 turns off the first solenoid valve 174 at a time point when the slide position reaches 198 mm before the top dead center after the product carry-out, and turns off the second solenoid valve 176, about 0.06 seconds behind. Thus, after the second system pressure acts on the rising pressure generating line 157 of the knockout cylinder 110, the first system pressure acts on the lowering pressure generating line 153, so that no surge generates in the lowering pressure generating line 153 or the rising pressure generating line 157 at operation start, and the knockout cylinder 110 lowers up to the lower setting position on which the lower limit stopper acts, at a time point when the slide 14 reaches almost the top dead center. At this time, the lowering speed is adjustable by adjustment of the throttle valve 172.

After the knockout pin 27 driven by the knockout cylinder 110 lowers up to a position where the knockout pin does not contact with the material 30, although not illustrated, when the slide 14 reaches 190 mm, a material feeding device holds the material 30, and sets the material on the lower die 22. At the time of setting the material 30 on the lower die 22, when the knockout pin 27 exists at a place where the material 30 is set, a posture of the material 30 is deteriorated, and therefore the knockout pin 27 is retreated downward, and thereafter the material 30 is set.

A single multipurpose carrying robot (manipulator) may be used as the product carrying-out device and the material feeding device.

Configuration of Hydraulic Knockout Device of Second Embodiment

Figure 8:
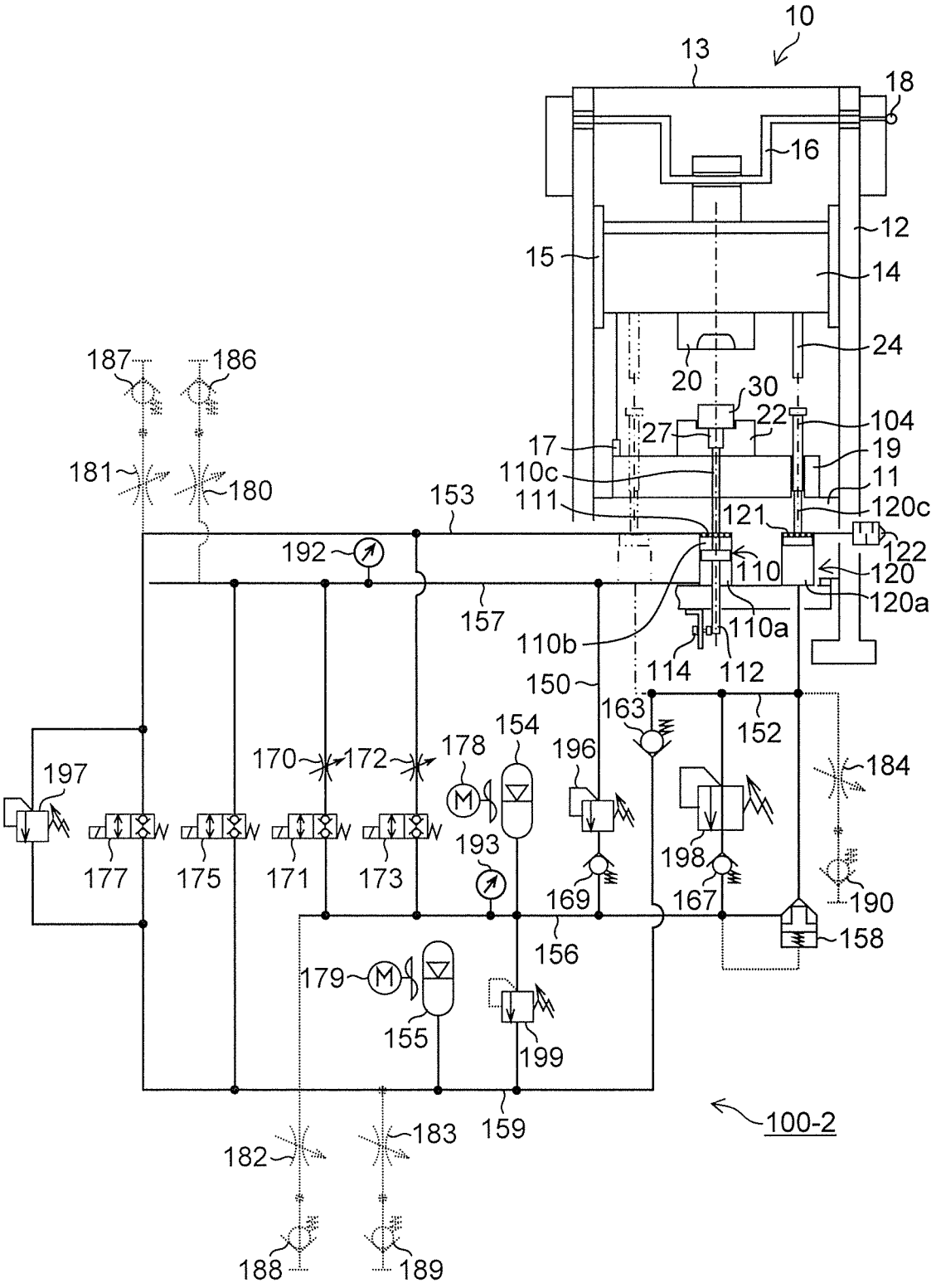
FIG. 8 is a configuration diagram illustrating a second embodiment of an oil hydraulic knockout device.

FIG. 8 is a configuration diagram illustrating a second embodiment of an oil hydraulic knockout device according to the presently disclosed subject matter. In FIG. 8, portions common with the portions of the oil hydraulic knockout device 100-1 of the first embodiment illustrated in FIG. 1 are designated by the same reference numerals, and detailed description thereof will be omitted.

An oil hydraulic knockout device 100-2 of the second embodiment illustrated in FIG. 8 is different from the oil hydraulic knockout device 100-1 of the first embodiment illustrated in FIG. 1 in that a pilot driving type logic valve 158 is used in place of the first check valve 161, a 1st-1 solenoid valve 171 and a 1st-2 solenoid valve 175 are used in place of the first solenoid valve 174, a 2nd-1 solenoid valve 173 and a 2nd-2 solenoid valve 177 are used in place of the second solenoid valve 176, the lower limit stopper 113 of the second oil hydraulic cylinder 110 is abolished, and a cam rod 112 and a limit switch 114 that determine a lower stop position of a second oil hydraulic cylinder 110 are provided, mainly.

The logic valve 158 functions similarly to the first check valve 161 of the first embodiment, and has a characteristic of facilitating design and attaining a lower cost since a working shape necessary for mounting on an oil hydraulic block (oil hydraulic manifold) is constant for each logic valve of each capacity (each allowable hydraulic oil amount) (regardless of manufacturer of the logic valve).

Hereinafter, action of the logic valve 158 will be described.

Figure 9:
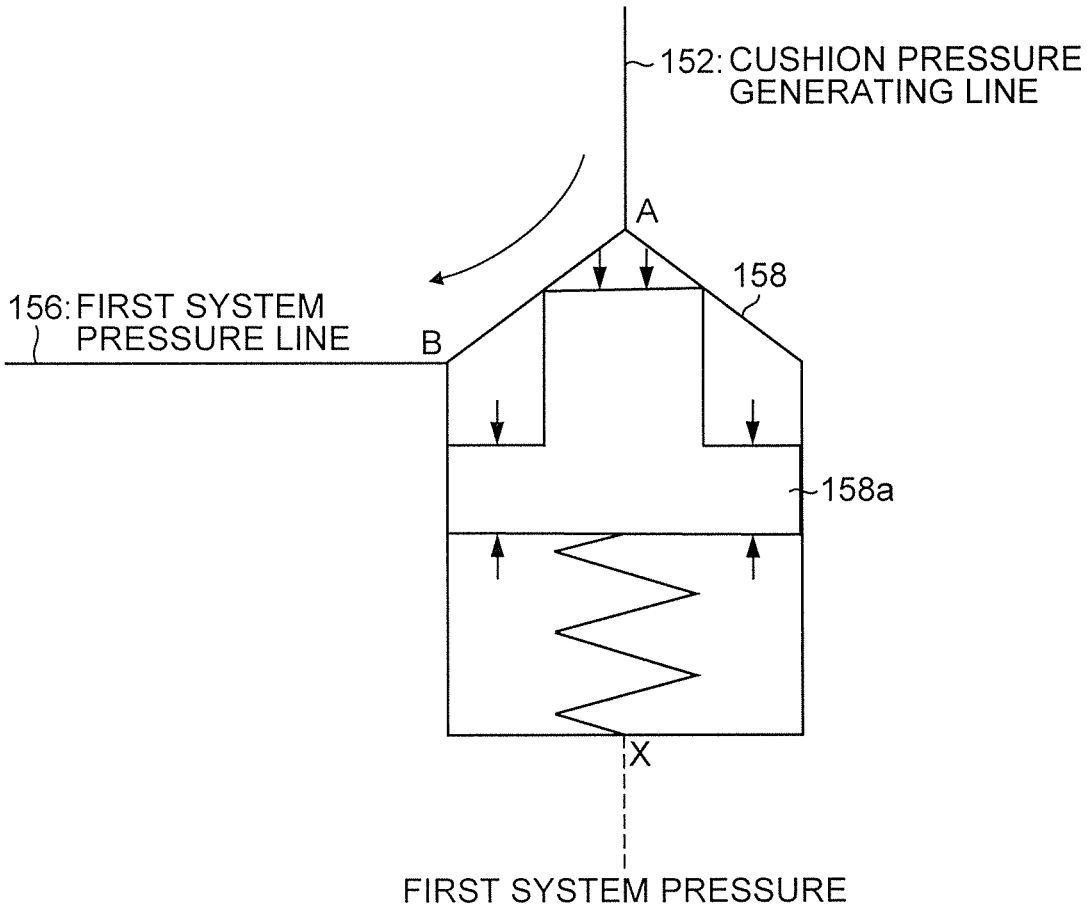
FIG. 9 is an enlarged diagram of a logic valve illustrated in FIG. 8.

FIG. 9 is an enlarged diagram of the logic valve 158 illustrated in FIG. 8. In FIG. 9, a cushion pressure generating line 152 and a first system pressure line 156 are connected to an A port and a B port of the logic valve 158, respectively, cushion pressure and first system pressure are applied to the A port and the B port, and the first system pressure normally acts on a pilot port (X port).

Where pressure that acts on the cushion pressure generating line 152 is denoted by Pc (kg/cm$^2$), the first system pressure is denoted by P1 (kg/cm$^2$), the cracking pressure of the logic valve 158 is denoted by Pk (kg/cm$^2$), the poppet area (on which the cushion pressure acts) of the logic valve 158 is denoted by a (cm$^2$), and the annular area of the logic valve 158 is denoted by b (cm$^2$), a conditional expression to open a poppet 158*a* to cause hydraulic oil to flow is expressed by the following [Expression 1], and [Expression 1']. [Expression 1'] is an expression obtained by rewriting [Expression 1].

$$Pc \times a > \{P1 \times (a+b) + Pk \times a - P1 \times b\} \quad \text{[Expression 1]}$$

$$Pc > P1 + Pk \quad \text{[Expression 1']}$$

When pressure that satisfies [Expression 1'], namely, the pressure Pc of the cushion pressure generating line 152 becomes larger than pressure obtained by adding the first system pressure P1 to the cracking pressure Pk (which acts in such a direction as to close the logic valve 158 by a spring), the poppet 158*a* is opened, and hydraulic oil flows from the cushion pressure generating line 152 to the first system pressure line 156.

The 1st-1 solenoid valve 171 is a 2-port poppet type solenoid valve that switches connection or disconnection between the rising pressure generating line 157 and the first system pressure line 156, the 1st-2 solenoid valve 175 is a 2-port poppet type solenoid valve that switches connection or disconnection between the rising pressure generating line 157 and the second system pressure line 159, and these 1st-1 solenoid valve 171 and 1st-2 solenoid valve 175 function similarly to the 3-port first solenoid valve 174.

The 2nd-1 solenoid valve 173 is a 2-port poppet type solenoid valve that switches connection or disconnection between a lowering pressure generating line 153 and the first system pressure line 156, the 2nd-2 solenoid valve 177 is a 2-port poppet type solenoid valve that switches connection or disconnection between the lowering pressure generating line 153 and the second system pressure line 159, and these 2nd-1 solenoid valve 173 and 2nd-2 solenoid valve 177 function similarly to the 3-port second solenoid valve 176.

The oil hydraulic knockout device 100-1 of the first embodiment that raises and lowers the second oil hydraulic cylinder 110 by turning on/off of the first solenoid valve 174 and the second solenoid valve 176 can pressurize the second oil hydraulic cylinder 110 downward in a basic state (both the solenoid valves are in OFF states) to hold the second oil hydraulic cylinder 110 at a lower stop position where the (adjustable) lower limit stopper 113 acts, and therefore the oil hydraulic knockout device 100-1 is characterized in that even when a slight leak occurs in any of the solenoid valves, abnormal operation (for example, unexpected rising) is easily avoided, and the number of solenoid valves to be used is reduced.

The oil hydraulic knockout device 100-2 of the second embodiment that raises and lowers the second oil hydraulic cylinder 110 by turning on/off of the 1st-1 solenoid valve 171 and the 1st-2 solenoid valve 175, and turning on/off of the 2nd-1 solenoid valve 173 and the 2nd-2 solenoid valve 177 can hold the second oil hydraulic cylinder 110 at the position by disconnecting both pressure generating lines from others without keeping pressurizing the second oil hydraulic cylinder 110 downward and upward in a basic state (all the solenoid valves are in OFF states), and therefore can stop the second oil hydraulic cylinder 110 at a lower stop position without applying the lower limit stopper (by using a cam rod 112 and a manual adjustable limit switch 114), and is characterized in that there are a lot of selectable types (large selection of goods) because the solenoid valves have (2-port type) simple configurations.

[Controller]

Figure 10:
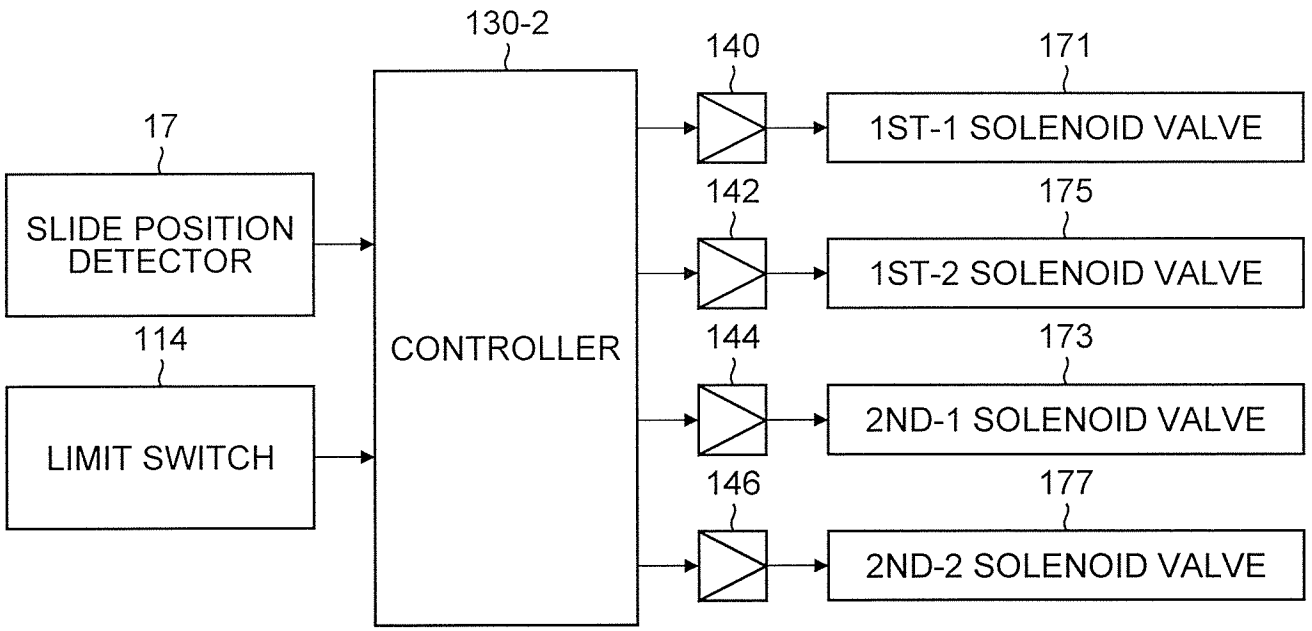
FIG. 10 is a block diagram illustrating a controller applied to the oil hydraulic knockout device of the second embodiment.

FIG. 10 is a block diagram illustrating a controller 130-2 applied to the oil hydraulic knockout device 100-2 of the second embodiment.

The controller 130-2 illustrated in FIG. 10 on/off-controls the 1st-1 solenoid valve 171, the 1st-2 solenoid valve 175, the 2nd-1 solenoid valve 173, and the 2nd-2 solenoid valve 177 of an oil hydraulic closed circuit 150 illustrated in FIG. 9, and on/off-controls relays 140, 142, 144, 146 in accordance with a position signal of a slide 14 detected by a slide position detector 17 and a detection signal of a limit switch 114, outputs a driving current to solenoids of the 1st-1 solenoid valve 171, the 1st-2 solenoid valve 175, the 2nd-1 solenoid valve 173, and the 2nd-2 solenoid valve 177 through the on/off-controlled relays 140, 142, 144, 146, and on/off-controls the 1st-1 solenoid valve 171, the 1st-2 solenoid valve 175, the 2nd-1 solenoid valve 173, and the 2nd-2 solenoid valve 177 individually. The specific timing of the on/off-control of the 1st-1 solenoid valve 171, the 1st-2 solenoid valve 175, the 2nd-1 solenoid valve 173, and the 2nd-2 solenoid valve 177 by the controller 130-2 will be described below.

[Knockout Control]

<Press Lowering Process of First Cycle>

Figure 11:
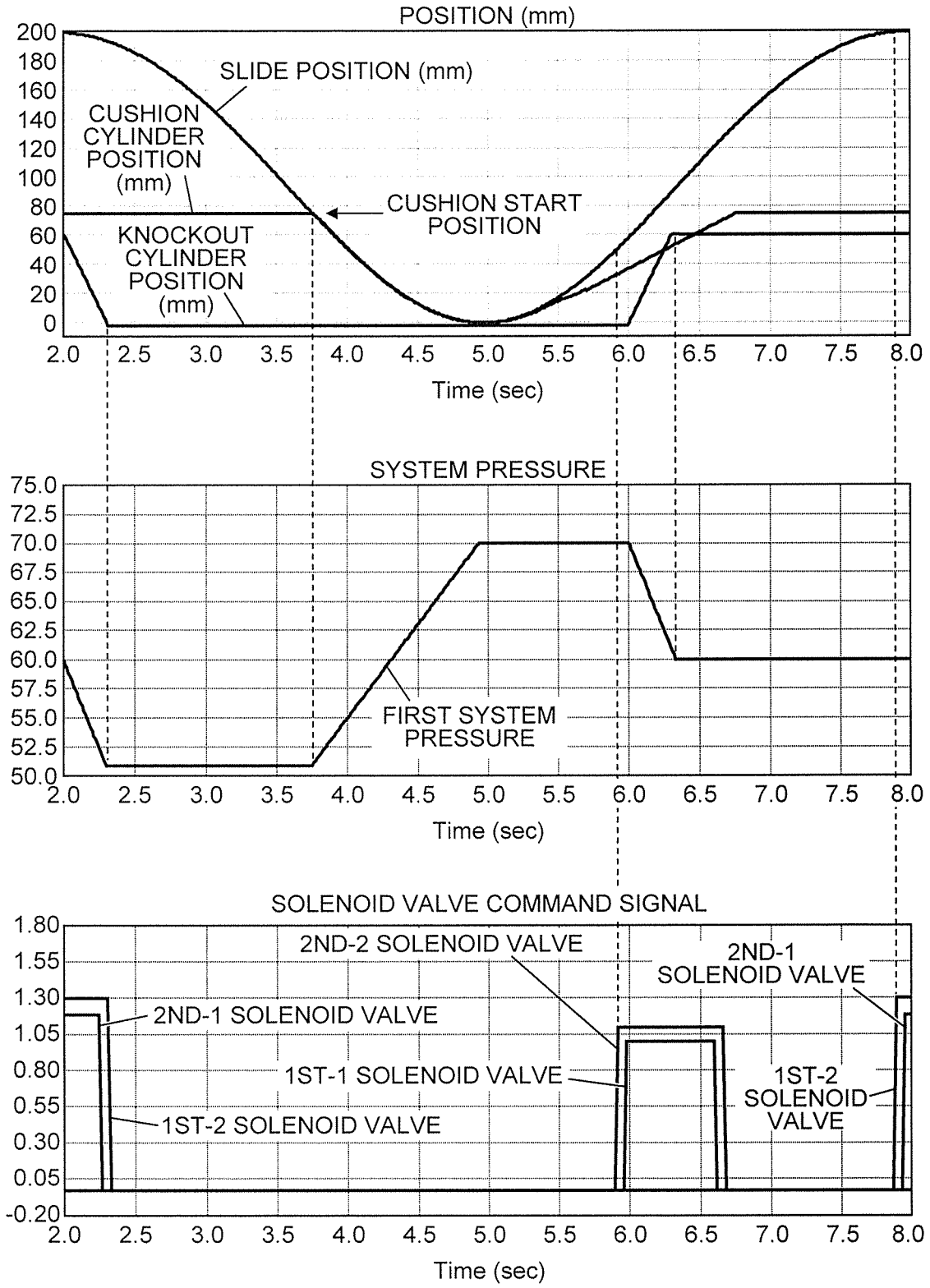
FIG. 11 is a waveform chart illustrating a state of each portion in one cycle of a second cycle and a subsequent cycle after start of operation of a press machine and the oil hydraulic knockout device of the second embodiment.

FIG. 11 is a waveform chart illustrating a state of each portion in one cycle of a second cycle and a subsequent cycle after start of operation of the press machine 10 and the oil hydraulic knockout device 100-2 of the second embodiment, and is particularly different from FIG. 7 in a graph of a lower stage illustrating a waveform of a solenoid valve command signal.

In FIG. 11, illustration of a first cycle is omitted, but at an operation start time point, the press/slide is at a top dead center, the knockout cylinder 110 is at a (press) bottom dead center (vicinity (slightly below the bottom dead center)). In other words, the 1st-1 solenoid valve 171 and the 1st-2 solenoid valve 175, and the 2nd-1 solenoid valve 173 and the 2nd-2 solenoid valve 177 each are in an OFF state, both the rising pressure generating line 157 and the lowering pressure generating line 153 are disconnected from other pressure generating line, so that the knockout cylinder 110 is stopped at a lower setting position slightly below the bottom dead center.

The first system pressure is about 51 kg/cm$^2$. A material 30 is set to a lower die 22.

Second system pressure acts on the cushion pressure generating line 152 of the cushion cylinder 120 through a second check valve 163, and the cushion cylinder 120 is in a state of being pressed against an upper limit stopper 121 (upper limit position).

When the press/slide reaches a cushion start position, the slide 14 presses a piston rod 120*c* of the cushion cylinder 120 through a press-down member 24 and a cushion pin 104, and hydraulic oil of the cushion pressure generating line 152 is displaced to the first system pressure line 156 through a logic valve 158. At this time, the pressure of the first system pressure line rises up to 70 kg/cm$^2$ by a stored amount of the hydraulic oil, and maintains a maximum value during the cycle. This (action) performs immediately after the above, and is favorable to knockout action requiring knockout force (by the knockout cylinder 110).

Thus, during lowering of the press/slide, a part of kinetic energy of the press is absorbed as energy of pressure oil.

The press forming is performed at this time (during this), and therefore a play (clearance) section previously pressed to one direction side (comes into contact at the time of forming) by the balancer cylinder is more firmly pressed in one direction to accomplish forming. The cushion cylinder 120 also serves for further stabilizing action of stabilizing vibration behavior which is likely to be generated by play at the time of forming start.

<Press Rising Process>

When the slide 14 starts rising from the bottom dead center, and a press-down member 24 is separated from the cushion pin 104, the cushion pressure generating line 152 on which pressure slightly larger than the first system pressure (larger by the cracking pressure of the logic valve 158) acts is released by the amount corresponding to the elastic compression, and the second system pressure of the second system pressure line 159 acts on the cushion pressure generating line 152 through the second check valve 163, and the cushion cylinder 120 rises at a low speed.

The movable mass of the cushion cylinder 120 is limited to the piston rod 120*c* and the cushion pin 104, and is relatively low inertia, and therefore when relatively small second system pressure of about 8 kg/cm$^2$ acts, the cushion cylinder 120 can rise at a relatively slow speed (slowly). In this embodiment, at a time point when the press/slide half rises, the cushion cylinder 120 acts on the upper limit stopper 121 to reach an initial position. The cushion cylinder 120 only needs to be able to return to the initial position before the slide 14 reaches the cushion start position in a next cycle of press/slide lowering process at the latest.

The controller 130-2 turns on the 2nd-2 solenoid valve 177 at a time point when the slide reaches (rises) 50 mm, and turns on the 1st-1 solenoid valve 171, about 0.06 seconds behind. Thus, after the second system pressure is made to act on the lowering pressure generating line 153 of the knockout cylinder 110, the first system pressure is made to act on the rising pressure generating line 157, so that no surge generates in the rising pressure generating line 157 or the lowering pressure generating line 153 at operation start, and the knockout cylinder 110 performs knockout action for a product while rising up to a position where an upper limit stopper 111 acts, at a time point when the slide 14 reaches about 60 mm.

The first system pressure lowers up to about 60 kg/cm$^2$ by an amount of the knockout operation. At this time, the knockout speed is adjustable by adjustment of a throttle valve 170.

Time that sufficiently reaches an upper limit is expected from an expectable knockout speed, and in order not to generate surge, the 1st-1 solenoid valve 171 is turned off, the 2nd-2 solenoid valve 177 is turned off, about 0.06 seconds behind, and the rising pressure generating line 157 of the knockout cylinder 110 is disconnected from the first system pressure line 156, and thereafter the lowering pressure generating line 153 is disconnected from the second system pressure line 159.

After the knockout action, although not illustrated, a product carrying-out device holds the product, and carries out the product to a subsequent process. During this, the slide 14 is coming to almost a final stage of the rising process.

<Lowering Process of Second Cycle and Subsequent Cycle>

The controller 130-1 turns on the 1st-2 solenoid valve 175 at a time point when the slide position reaches 198 mm before the top dead center after the product carry-out, and turns on the 2nd-1 solenoid valve 173, about 0.06 seconds behind. Thus, after the second system pressure acts on the rising pressure generating line 157 of the knockout cylinder 110, the first system pressure acts on the lowering pressure generating line 153, so that no surge generates in the lowering pressure generating line 153 or the rising pressure generating line 157 at operation start, and the knockout cylinder 110 lowers up to the lower setting position where the limit switch 114 acts on the cam rod 112 interlocked with the knockout cylinder 110, at a time point when the slide 14 reaches almost the top dead center. In other words, at a time point when the limit switch 114 acts, the controller 130-2 turns off the 2nd-1 solenoid valve 173, and turns off the 1st-2 solenoid valve 175 about 0.06 seconds behind (by a timer). Thus, the lowering pressure generating line 153 of the knockout cylinder 110 is disconnected from the first system pressure line 156, and thereafter the rising pressure generating line 157 is disconnected from the second system pressure line 159, so that the knockout cylinder 110 stops at the lower setting position vicinity without generating surge in the lowering pressure generating line 153 or the rising pressure generating line 157 at the time of stop. At this time, the lowering speed is adjustable by adjustment of the throttle valve 172.

After the knockout pin 27 driven by the knockout cylinder 110 lowers up to a position where the knockout pin does not contact with the material 30, although not illustrated, when the slide 14 reaches up to 190 mm, a material feeding device holds the material 30, and sets the material on the lower die 22.

OTHERS

In the first embodiment, the second oil hydraulic cylinder (knockout cylinder) 110 is caused to perform rising and lowering operation by switching of the 3-port first solenoid valve 174 and the 3-port second solenoid valve 176, and in the second embodiment, the knockout cylinder 110 is caused to perform rising and lowering operation by switching of the 2-port 1st-1 solenoid valve 171, the 2-port 1st-2 solenoid valve 175, the 2-port 2nd-1 solenoid valve 173 and the 2-port 2nd-2 solenoid valve 177, but the configuration of each solenoid valve is not limited to the configurations illustrated in the first embodiment and the second embodiment. In short, any solenoid valve which causes the knockout cylinder 110 to perform the rising and lowering operation by switching may be employed.

In this embodiment, a case where oil is used as hydraulic fluid of the hydraulic knockout device is described. However, the hydraulic fluid is not limited to this, and water or other liquid may be used. In other words, in this embodiment, a form where the oil hydraulic cylinder and the oil hydraulic closed circuit are used is described, but the presently disclosed subject matter is not limited to this, and it goes without saying that the hydraulic cylinder and the hydraulic closed circuit using water or other liquid can be used in the presently disclosed subject matter. Additionally, the hydraulic knockout device according to the presently disclosed subject matter is not limited to a crank press, and can be applied to various types of press machines including a mechanical press.

Furthermore, it goes without saying that the presently disclosed subject matter is not limited to the above embodiments, various improvements and modifications may be performed without departing the scope of the presently disclosed subject matter.

What is claimed is:

1. A hydraulic knockout device comprising:

an energy conversion section configured to convert a part of kinetic energy during lowering a slide of a press machine into hydraulic energy;

an energy storage section configured to store the hydraulic energy converted by the energy conversion section; and a knockout section configured to take out a product worked by the press machine from the press machine, the knockout section configured to convert the hydraulic energy discharged from the energy storage section into kinetic energy to knock out the product, wherein the energy conversion section includes:

a cushion pin pressed down with lowering operation of the slide; and a first hydraulic cylinder having a piston rod which comes into contact with the cushion pin, wherein the energy storage section is a first accumulator configured to store hydraulic fluid displaced from a rising side pressure generating chamber of the first hydraulic cylinder through the cushion pin when the slide is lowered, wherein the knockout section is a second hydraulic cylinder having a rising side pressure generating chamber to which the hydraulic fluid stored in the first accumulator in knockout operation is fed, wherein the hydraulic knockout device further comprises a second accumulator configured to store hydraulic fluid having second system pressure lower than hydraulic fluid having first system pressure stored in the first accumulator, wherein the second accumulator stores hydraulic fluid displaced from a lowering side pressure generating chamber of the second hydraulic cylinder in the knockout operation, and feeds the hydraulic fluid to the rising side pressure generating chamber of the first hydraulic cylinder with rising of the slide to raise the cushion pin, wherein a hydraulic closed circuit in which the hydraulic fluid is pressurized and filled is comprised of the first hydraulic cylinder, the second hydraulic cylinder, the first accumulator and the second accumulator, and wherein the hydraulic closed circuit does not include a hydraulic pump configured to pressurize and feed the hydraulic fluid.

2. The hydraulic knockout device according to claim 1, wherein the hydraulic closed circuit further includes a cushion pressure generating line connected to the rising side pressure generating chamber of the first hydraulic cylinder, a rising pressure generating line connected to the rising side pressure generating chamber of the second hydraulic cylinder, a lowering pressure generating line connected to the lowering side pressure generating chamber of the second hydraulic cylinder, a first system pressure line connected to the first accumulator, and a second system pressure line connected to the second accumulator, and wherein the hydraulic knockout device further comprises:

a first check valve that is disposed between the cushion pressure generating line and the first system pressure line, the first check valve configured to allow flow of hydraulic fluid from the cushion pressure generating line to the first system pressure line;

a second check valve that is disposed between the cushion pressure generating line and the second system pressure line, the second check valve configured to allow flow of hydraulic fluid from the second system pressure line to the cushion pressure generating line;

one or a plurality of first solenoid valves that are disposed between the rising pressure generating line and the first system pressure line, and between the rising pressure generating line and the second system pressure line, the one or a plurality of first solenoid valves configured to connect the rising pressure generating line to the first system pressure line in the knockout operation, and connect the rising pressure generating line to the second system pressure line after termination of the knockout operation; and one or a plurality of second solenoid valves that are disposed between the lowering pressure generating line and the first system pressure line, and between the lowering pressure generating line and the second system pressure line, the one or a plurality of second solenoid valves configured to connect the lowering pressure generating line to the second system pressure line in the knockout operation, and connect the lowering pressure generating line to the first system pressure line after termination of the knockout operation, wherein the hydraulic fluid is pressurized and confined in the hydraulic closed circuit, hydraulic fluid in the first system pressure line is pressurized only by the hydraulic fluid displaced from the rising side pressure generating chamber of the first hydraulic cylinder through the cushion pin during the lowering of the slide in one cycle period of the press machine.

3. The hydraulic knockout device according to claim 2, wherein the first solenoid valve is a single solenoid valve configured to switch connection between the rising pressure generating line and the first system pressure line, or connection between the rising pressure generating line and the second system pressure line, and the second solenoid valve is a single solenoid valve configured to switch connection between the lowering pressure generating line and the first system pressure line, or connection between the lowering pressure generating line and the second system pressure line.

4. The hydraulic knockout device according to claim 2, wherein the first solenoid valve includes a plurality of solenoid valves including a 1st-1 solenoid valve configured to switch connection or disconnection between the rising pressure generating line and the first system pressure line, and a 1st-2 solenoid valve configured to switch connection or disconnection between the rising pressure generating line and the second system pressure line, and the second solenoid valve includes a plurality of solenoid valves including a 2nd-1 solenoid valve configured to switch connection or disconnection between the lowering pressure generating line and the first system pressure line, and a 2nd-2 solenoid valve configured to switch connection or disconnection between the lowering pressure generating line and the second system pressure line.

5. The hydraulic knockout device according to claim 2, wherein the first solenoid valve and the second solenoid valve each are a poppet type solenoid valve.

6. The hydraulic knockout device according to claim 2, further comprising a controller configured to control the first solenoid valve and the second solenoid valve such that the second hydraulic cylinder is raised and thereafter lowered in a period from a time point when the slide of the press machine starts rising until a time point when the cushion pin starts lowering with lowering operation of the slide.

7. The hydraulic knockout device according to claim 2, further comprising a cooling device configured to cool hydraulic fluid in the hydraulic closed circuit.

8. The hydraulic knockout device according to claim 2, wherein oil feeding and system pressure confining throttle valves, or throttle valves and couplers are mounted on the cushion pressure generating line, the first system pressure line, the second system pressure line, the rising pressure generating line, and the lowering pressure generating line.

9. The hydraulic knockout device according to claim 2, wherein a liquid feeding device including:

a tank configured to store the hydraulic fluid;

a discharge port configured to feed the hydraulic fluid to the hydraulic closed circuit;

a return port to which the hydraulic fluid is returned from the hydraulic closed circuit, the return port being connected to the tank; and a hydraulic pump configured to feed the hydraulic fluid from the tank to the hydraulic closed circuit through the discharge port, and the hydraulic pump is driven only when the hydraulic pump pressurizes and confines the hydraulic fluid in the hydraulic closed circuit.

10. The hydraulic knockout device according to claim 9, wherein an extension hose connected to at least one of the discharge port and the return port is attached to the liquid feeding device, and a coupler is provided in each of both ends of the extension hose.

11. The hydraulic knockout device according to claim 1, wherein the hydraulic closed circuit further includes a cushion pressure generating line connected to the rising side pressure generating chamber of the first hydraulic cylinder, a rising pressure generating line connected to the rising side pressure generating chamber of the second hydraulic cylinder, a lowering pressure generating line connected to the lowering side pressure generating chamber of the second hydraulic cylinder, a first system pressure line connected to the first accumulator, and a second system pressure line connected to the second accumulator, and wherein the hydraulic knockout device further comprises:

a logic valve disposed between the cushion pressure generating line and the first system pressure line, the logic valve being a pilot driving type logic valve configured to use first system pressure of the first system pressure line as pilot pressure so as to allow flow of hydraulic fluid from the cushion pressure generating line to the first system pressure line;

a second check valve that is disposed between the cushion pressure generating line and the second system pressure line, the second check valve configured to allow flow of hydraulic fluid from the second system pressure line to the cushion pressure generating line;

one or a plurality of first solenoid valves that are disposed between the rising pressure generating line and the first system pressure line, and between the rising pressure generating line and the second system pressure line, the one or a plurality of first solenoid valves configured to connect the rising pressure generating line to the first system pressure line in the knockout operation, and connect the rising pressure generating line to the second system pressure line after termination of the knockout operation; and one or a plurality of second solenoid valves that are disposed between the lowering pressure generating line and the first system pressure line, and between the lowering pressure generating line and the second system pressure line, the one or a plurality of second solenoid valves configured to connect the lowering pressure generating line to the second system pressure line in the knockout operation, and connect the lowering pressure generating line to the first system pressure line after termination of the knockout operation, wherein the hydraulic fluid is pressurized and confined in the hydraulic closed circuit, hydraulic fluid in the first system pressure line is pressurized only by the hydraulic fluid displaced from the rising side pressure generating chamber of the first hydraulic cylinder through the cushion pin during the lowering of the slide in one cycle period of the press machine.

12. The hydraulic knockout device according to claim 1, wherein a plurality of the first hydraulic cylinders are disposed, and respective rising side pressure generating chambers are communicated with each other.

13. The hydraulic knockout device according to claim 1, wherein on a lower surface of the slide, a press-down member configured to press down the cushion pin, or an upper die including a press-down member configured to press down the cushion pin is mounted.

* * * * *